US011441339B2

(12) United States Patent
Iwata et al.

(10) Patent No.: US 11,441,339 B2
(45) Date of Patent: Sep. 13, 2022

(54) VEHICULAR DOOR LOCK DEVICE

(71) Applicant: AISIN CORPORATION, Kariya (JP)

(72) Inventors: Takanori Iwata, Kariya (JP); Yasuhiko Sono, Kariya (JP)

(73) Assignee: AISIN CORPORATION, Aichi (JP)

( * ) Notice: Subject to any disclaimer, the term of this patent is extended or adjusted under 35 U.S.C. 154(b) by 145 days.

(21) Appl. No.: 16/688,217

(22) Filed: Nov. 19, 2019

(65) Prior Publication Data

US 2020/0157858 A1 May 21, 2020

(30) Foreign Application Priority Data

Nov. 19, 2018 (JP) ..... JP2018-216445

(51) Int. Cl.
*E05B 81/90* (2014.01)
*E05B 81/04* (2014.01)
*E05B 77/34* (2014.01)

(52) U.S. Cl.
CPC ..... *E05B 81/90* (2013.01); *E05B 77/34* (2013.01); *E05B 81/04* (2013.01)

(58) Field of Classification Search
CPC ..... Y10T 292/1082; Y10T 292/1047; E05B 81/90; E05B 65/1026; E05B 81/04;
(Continued)

(56) References Cited

U.S. PATENT DOCUMENTS 4,262,508 A * 4/1981 Davidson ..... E05B 77/34 16/431
4,790,163 A * 12/1988 Appelbaum ..... E05B 17/188 70/455

(Continued)

FOREIGN PATENT DOCUMENTS

DE 1169328 B * 4/1964 ..... E05B 17/188
DE 20312347 U1 * 10/2003 ..... E05B 81/90
DE 102014114945 A1 * 4/2016 ..... E05B 85/243
DE 102016108425 A1 * 11/2017 ..... E05B 15/0093
GB 794863 A * 5/1958 ..... E05B 17/188

(Continued)

OTHER PUBLICATIONS

Office Action (Notice of Reasons for Refusal) dated Jun. 23, 2022, by the Japanese Patent Office in corresponding Japanese Patent Application No. 2018-216445 and an English Translation of the Office Action. (11 pages).

*Primary Examiner* — Kristina R Fulton
*Assistant Examiner* — Steven A Tullia
(74) *Attorney, Agent, or Firm* — Buchanan Ingersoll & Rooney PC

(57) ABSTRACT

A vehicular door lock device includes: a base portion rotatably supporting a latch holding a vehicle door in a closed state by engaging with a striker; a switching mechanism switching between a lock state where releasing of the engagement between the latch and the striker during a door opening operation of a door operation handle provided on the vehicle door is prohibited and an unlock state where releasing of the engagement between the latch and the striker during the door opening operation of the door operation handle is allowed; an electric mechanism capable of electrically switching the switching mechanism between the lock state and the unlock state; a housing accommodating the switching mechanism and the electric mechanism and connected to the base portion; and a blocking member disposed in the housing. An opening through which an operation tool is insertable is provided on the base portion.

6 Claims, 18 Drawing Sheets

(58) Field of Classification Search
CPC ..... E05B 77/34; E05B 17/14; E05B 17/002; E05B 85/20; E05B 85/24; E05B 85/243; E05B 85/26; E05B 17/181; E05B 17/188; E05B 13/001; Y10S 292/23; Y10S 292/65
USPC ..... 70/50, 423–428, 455, 278.7, 279.1
See application file for complete search history.

(56) References Cited

U.S. PATENT DOCUMENTS

| | | | | |
|---|---|---|---|---|
| 7,581,423 | B2 * | 9/2009 | Brojanac | E05B 17/002 70/423 |
| 9,708,837 | B2 * | 7/2017 | Bendel | E05B 85/00 |
| 2009/0236863 | A1 * | 9/2009 | Akizuki | E05B 81/14 292/201 |
| 2011/0074170 | A1 * | 3/2011 | Tomaszewski | E05B 77/28 292/220 |
| 2011/0204673 | A1 * | 8/2011 | Gumbo | E05B 81/06 296/146.1 |
| 2017/0158033 | A1 | 6/2017 | Vazquez Orpinel et al. | |
| 2018/0216370 | A1 * | 8/2018 | Ishiguro | E05B 77/34 |

FOREIGN PATENT DOCUMENTS

| | | | | | |
|---|---|---|---|---|---|
| GB | 1228926 | A | * | 4/1971 | E05B 17/188 |
| GB | 1228927 | A | * | 4/1971 | E05B 17/188 |
| GB | 2240583 | A | * | 8/1991 | E05B 85/02 |
| JP | S62-014063 | U | | 1/1987 | |
| JP | H02-042859 | Y2 | | 11/1990 | |
| JP | 2009013639 | A | | 1/2009 | |
| WO | WO-8807118 | A1 | * | 9/1988 | E05B 77/34 |

* cited by examiner

VEHICULAR DOOR LOCK DEVICE

CROSS REFERENCE TO RELATED APPLICATIONS

This application is based on and claims priority under 35 U.S.C. § 119 to Japanese Patent Application 2018-216445, filed on Nov. 19, 2018, the entire contents of which are incorporated herein by reference.

TECHNICAL FIELD

This disclosure relates to a vehicular door lock device.

BACKGROUND DISCUSSION

A vehicular door lock device capable of electrically switching a vehicle door between a lock state and an unlock state is known in the related art. For example, JP 2009-13639A discloses an automotive door latch device including a base member, a locking/unlocking lever, and an electric drive source.

The base member rotatably supports a latch that holds the vehicle door in a closed state by engaging with a striker. The locking/unlocking lever is a lever that is rotatable between a locking position and an unlocking position. The locking position is a position where the release of the latch-striker engagement during the door opening operation of the door operation handle provided on the vehicle door (vehicle door opening) is prohibited. The unlocking position is a position where the release of the latch-striker engagement during the door opening operation of the door operation handle is allowed. The electric drive source switches the locking/unlocking lever from the locking position to the unlocking position and vice versa.

The automotive door latch device described in JP 2009-13639A is configured such that the vehicle door can be switched from the unlock state to the lock state even in the event of an electrical system fault (such as a flat battery) in a case where the automotive door latch device is attached to a key cylinder-less vehicle door. Specifically, a striker entry groove is formed in the base member and the striker entry groove is provided with an opening portion that penetrates the striker entry groove in the front-rear direction of a vehicle. The opening portion is provided at a position exposed to the outside when the vehicle door is open and the opening portion has a size that allows a key to be inserted. This opening portion is provided at a position where the locking/unlocking lever can be switched from the unlocking position to the locking position by the key inserted in the automotive door latch device through the opening portion. A lid portion capable of blocking the opening portion is provided in the upper end portion of the locking/unlocking lever. The lid portion blocks the opening portion by abutting against the peripheral edge portion of the opening portion of the base member when the locking/unlocking lever is at the unlocking position and the lid portion opens the opening portion by being separated from the peripheral edge portion of the opening portion when the locking/unlocking lever is at the locking position.

As for the automotive door latch device described in JP 2009-13639A, rainwater, dust, or the like is prevented from entering the device through the opening portion by the lid portion blocking the opening portion when the locking/unlocking lever is at the unlocking position. When the locking/unlocking lever is at the locking position, however, the lid portion is separated from the base member, the opening portion is kept open, and thus rainwater, dust, or the like may enter the device.

Thus, a need exists for a vehicular door lock device which is not susceptible to the drawback mentioned above.

SUMMARY

A vehicular door lock device according to an aspect of this disclosure includes a base portion rotatably supporting a latch holding a vehicle door in a closed state by engaging with a striker, a switching mechanism switching between a lock state where releasing of the engagement between the latch and the striker during a door opening operation of a door operation handle provided on the vehicle door is prohibited and an unlock state where releasing of the engagement between the latch and the striker during the door opening operation of the door operation handle is allowed, an electric mechanism capable of electrically switching the switching mechanism between the lock state and the unlock state, a housing accommodating the switching mechanism and the electric mechanism and connected to the base portion, and a blocking member disposed in the housing. An opening through which an operation tool is insertable from an outside of the base portion into the housing is provided at a part of the base portion facing the switching mechanism. The blocking member allows an operation for inserting the operation tool from an outside of the housing into the housing through the opening and an operation for switching the switching mechanism from the unlock state to the lock state by means of the operation tool inserted in the housing as a result of the operation, and blocks the opening when the operation tool is not inserted through the opening.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Figure 1:
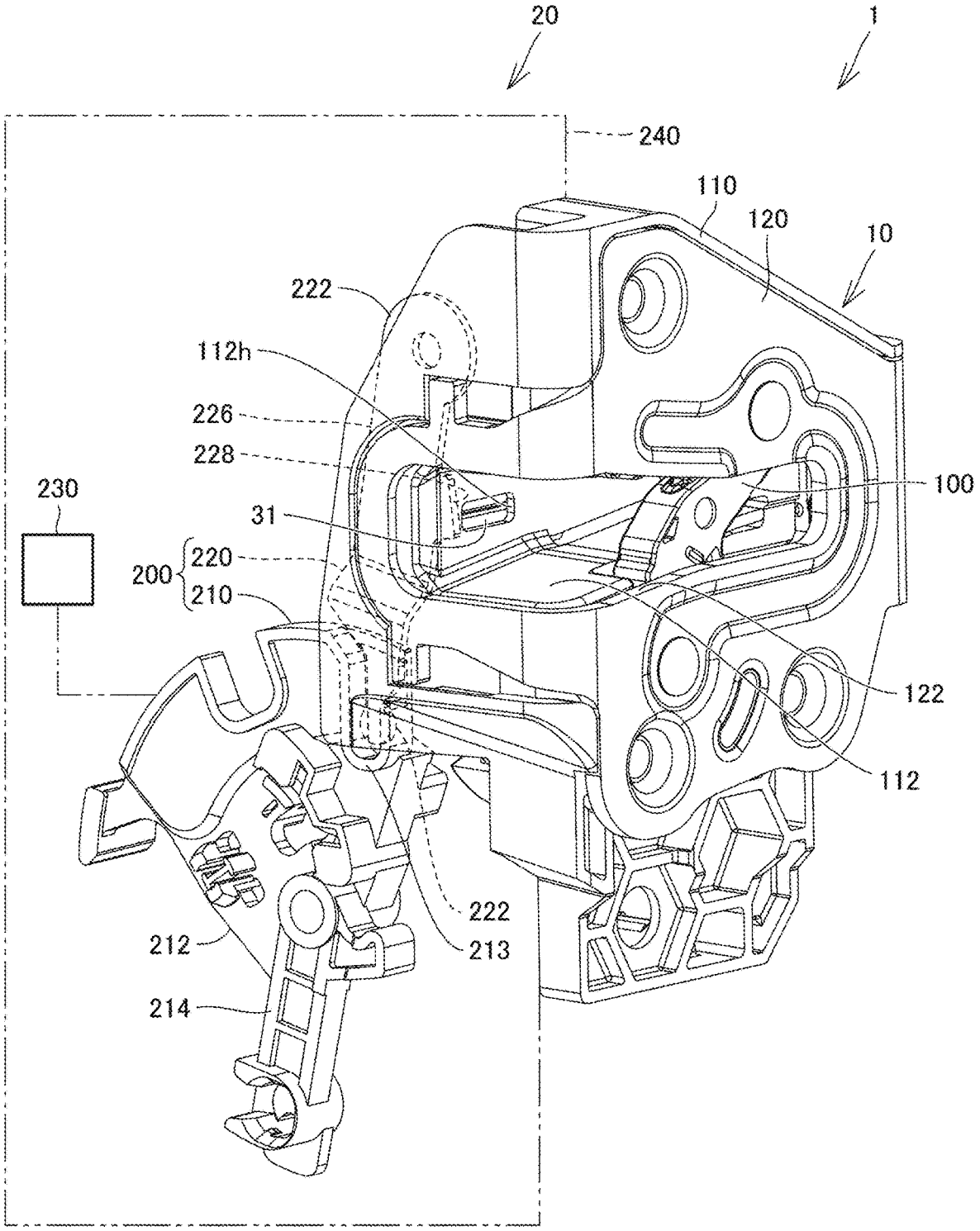
FIG. 1 is a perspective view of a vehicular door lock device according to a first embodiment disclosed here.

Embodiments disclosed here will be described with reference to the drawings. In the drawings referred to below, the same or corresponding members are denoted by the same reference numerals.

First Embodiment

A vehicular door lock device 1 according to a first embodiment disclosed here will be described with reference to FIGS. 1 to 12. FIG. 1 is a perspective view of the vehicular door lock device according to the first embodiment disclosed here. The vehicular door lock device 1 is assembled in a region partitioned by a door outer panel and a door inner panel of a vehicle door (such as a side door not provided with a key cylinder). As illustrated in FIG. 1, the vehicular door lock device 1 has a latch unit 10, an actuator unit 20, and a blocking member 31.

Figure 2:
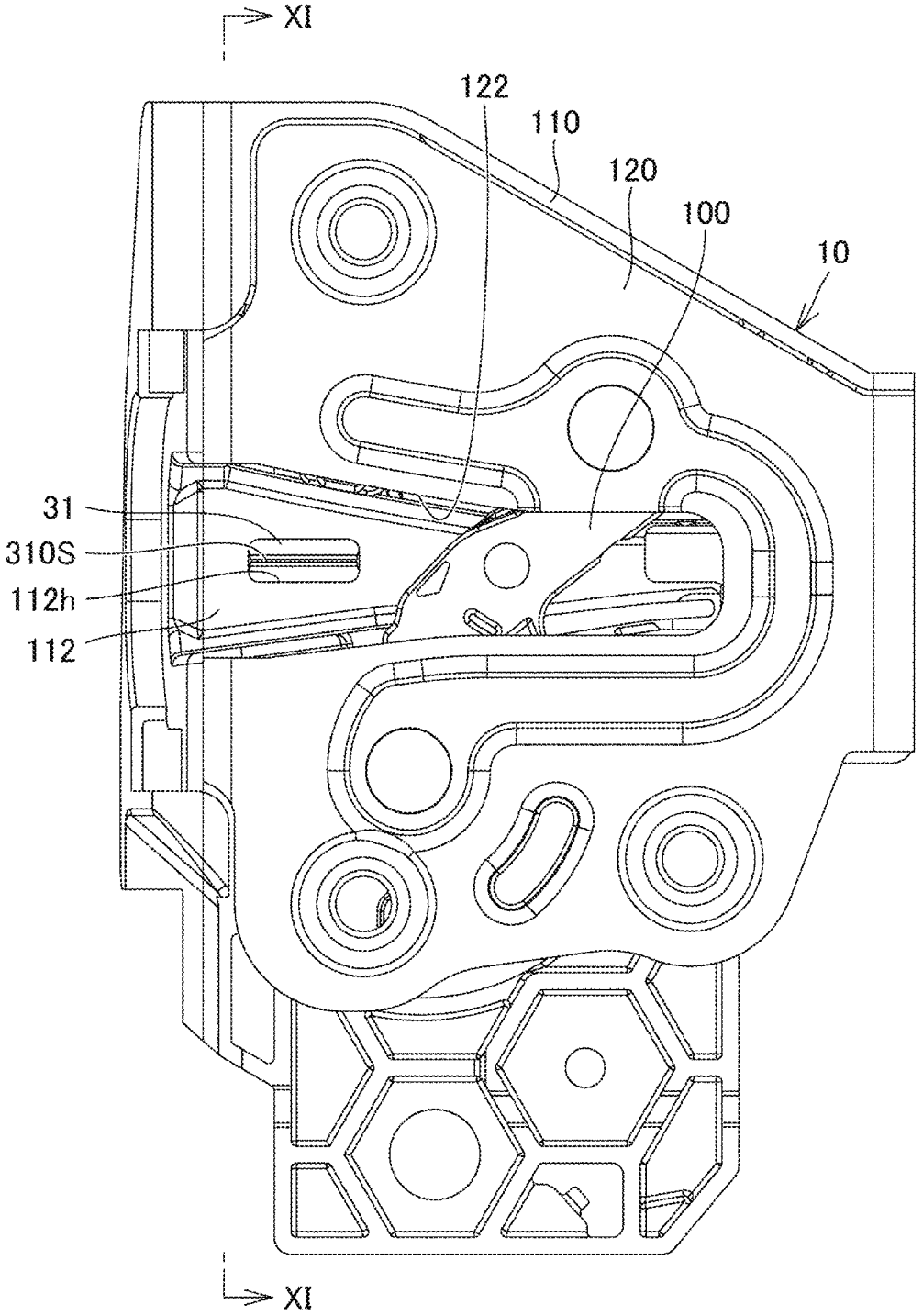
FIG. 2 is a plan view of a latch unit and a blocking member of the vehicular door lock device illustrated in FIG. 1.
Figure 3:
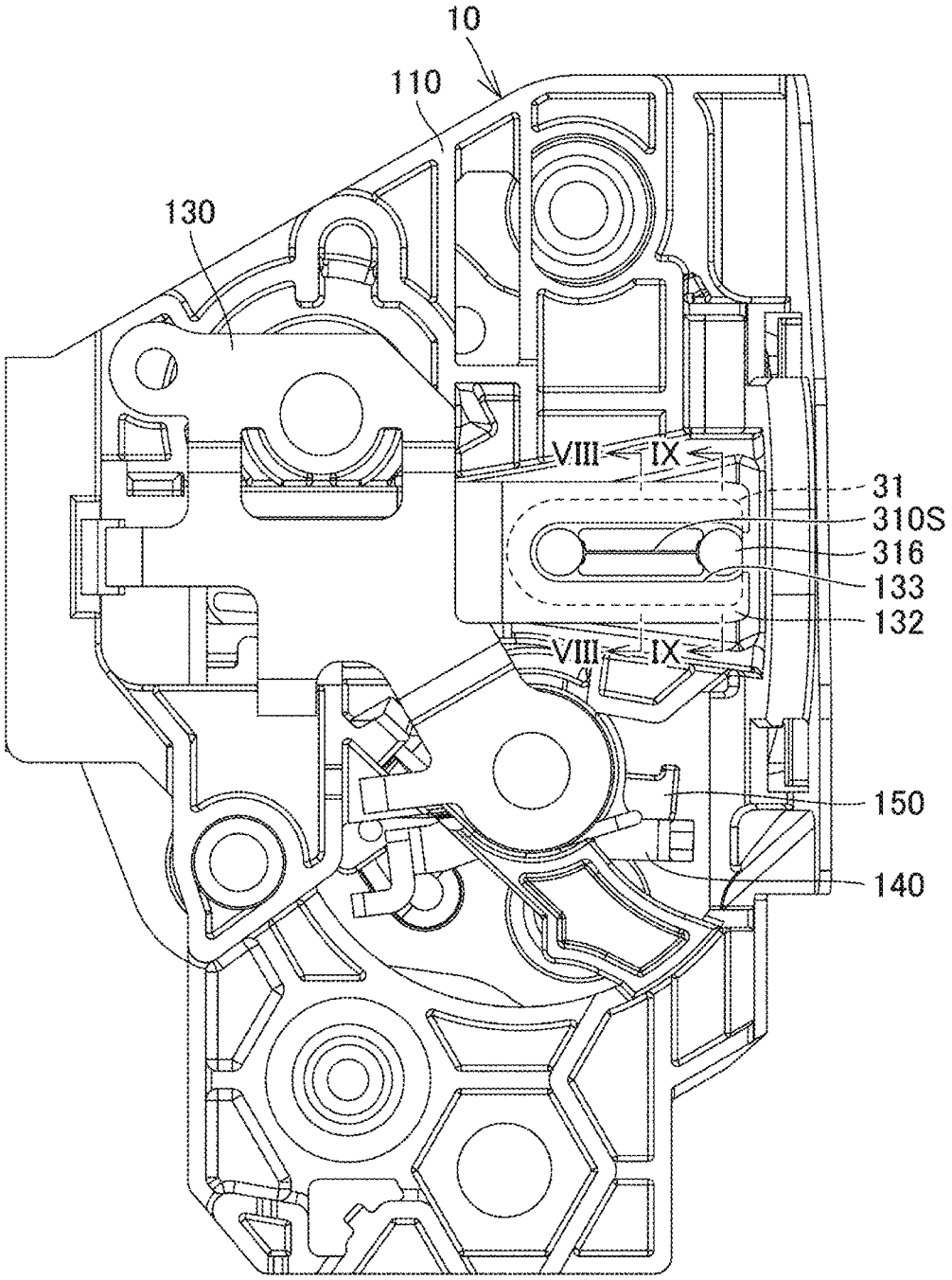
FIG. 3 is a rear view of the latch unit and the blocking member illustrated in FIG. 2.
Figure 4:
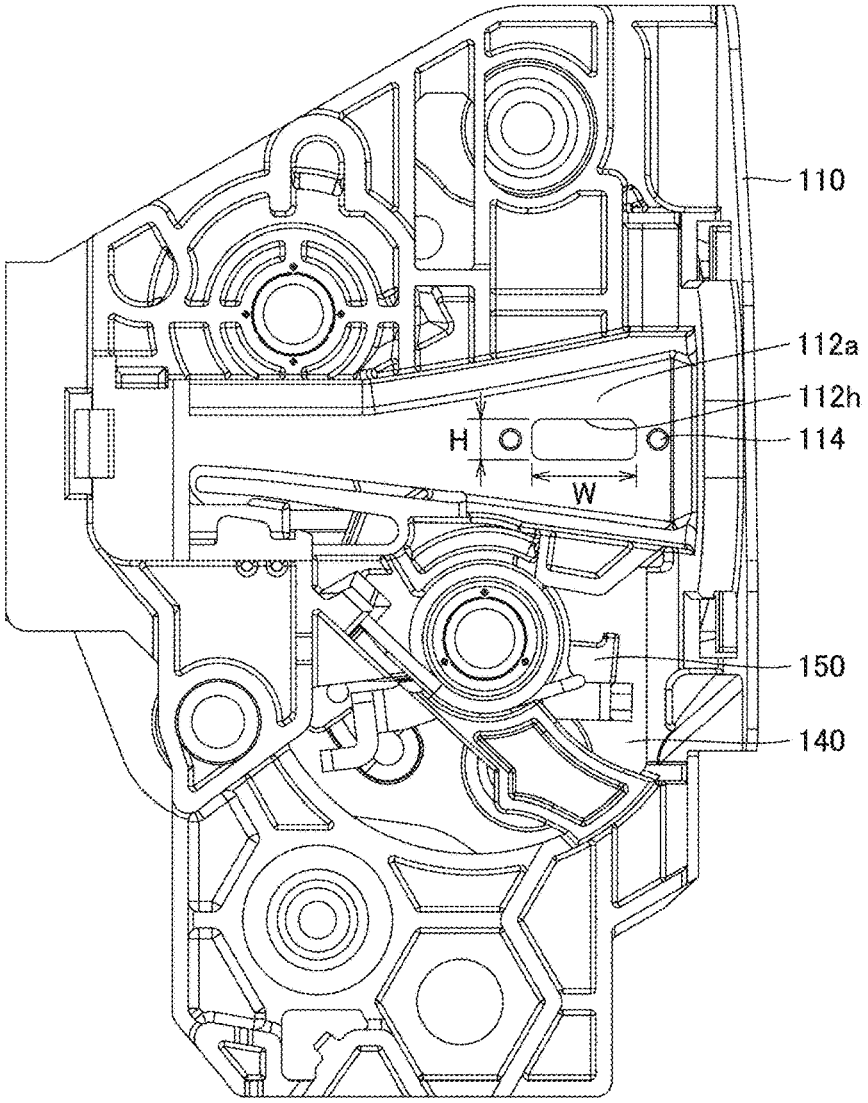
FIG. 4 is a rear view of a base portion, a lift lever, and a ratchet.

FIG. 2 is a plan view of the latch unit and the blocking member of the vehicular door lock device illustrated in FIG. 1. FIG. 3 is a rear view of the latch unit and the blocking member illustrated in FIG. 2. FIG. 4 is a rear view of a base portion, a lift lever, and a ratchet.

The latch unit 10 is a unit including a latch 100 and is configured to be detachable from the actuator unit 20. As illustrated in FIGS. 1 to 3, the latch unit 10 has the latch 100, a base portion 110, a front surface plate 120, a sub-base 130, a lift lever 140, and a ratchet 150.

The latch 100 holds the vehicle door in a closed state by engaging with a striker (not illustrated) provided in a vehicle.

The base portion 110 is a member that rotatably supports the latch 100, the lift lever 140, and the ratchet 150.

The base portion 110 is made of synthetic resin. The base portion 110 supports the latch 100 such that the latch 100 is rotatable between a state where the latch 100 and the striker are engaged (state where the vehicle door is closed) and a state where the engagement between the latch 100 and the striker is released (state where the vehicle door is allowed to open).

The base portion 110 has a groove portion 112 that allows the striker to enter. The groove portion 112 has a shape extending from one side portion (left side portion in FIG. 2) of the base portion 110 toward the other side portion (right side portion in FIG. 2) of the base portion 110 along a direction orthogonal to the axis of the latch 100. The base portion 110 supports the latch 100 such that a part of the latch 100 is positioned in the groove portion 112.

The groove portion 112 is provided with an opening **112*h* through which an operation tool K can be inserted in the direction parallel to the rotation axis of the latch 100 (depth direction of the page in FIG. 2**). Examples of the operation tool K include a key for locking and unlocking a vehicle door by being inserted into a key cylinder provided on the vehicle door.

As illustrated in FIG. 4, a dimension W of the opening **112*h* in a latch engagement direction parallel to the direction in which the latch 100 engages with the striker (left direction in FIG. 2) is larger than a dimension H of the opening 112*h* in an orthogonal direction (vertical direction in FIG. 2) orthogonal to both the insertion direction of the operation tool K (depth direction of the page in FIG. 2**) and the latch engagement direction.

Figure 9:
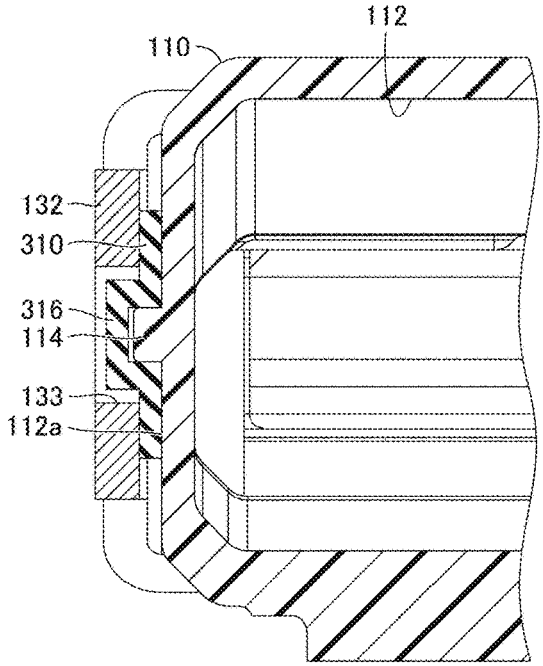
FIG. 9 is a cross-sectional view taken along line IX-IX illustrated in FIG. 3.

In the present embodiment, the base portion 110 has a holding portion 114 that holds the blocking member 31 as illustrated in FIG. 4. FIG. 9 is a cross-sectional view taken along line IX-IX illustrated in FIG. 3. As illustrated in FIGS. 4 and 9, the holding portion 114 has a shape projecting from a back surface **112*a* of the groove portion 112 in the direction parallel to the insertion direction of the operation tool K. The holding portion 114 holds the blocking member 31 at the position where the blocking member 31 blocks the opening 112*h***.

The lift lever 140 and the ratchet 150 are supported by the base portion 110. The lift lever 140 and the ratchet 150 are members for maintaining and releasing the engagement state between the latch 100 and the striker. Specifically, when the door opening operation of the door operation handle that is provided on the vehicle door is performed, the ratchet 150 is rotated by the lift lever 140 being pushed up via an open lever (not illustrated) and an open link (not illustrated). As a result, the latch 100 is rotated by the engagement between the latch 100 and the ratchet 150 being released, and thus the engagement between the latch 100 and the striker is released (the vehicle door is opened).

As illustrated in FIG. 2, the front surface plate 120 is connected to the base portion 110 from one side in the direction parallel to the rotation shaft of the latch 100 (front side in the depth direction of the page in FIG. 2). The front surface plate 120 is made of metal. The front surface plate 120 has a shape that covers the rotation shaft of the latch 100 and the rotation shaft of the ratchet 150. The rotation shaft of the latch 100 and the rotation shaft of the ratchet 150 are caulked and fixed to the front surface plate 120. As a result, the front surface plate 120 fixes the latch 100 and the ratchet 150 to the base portion 110.

The front surface plate 120 has a plate groove portion 122 that allows the striker to enter. The plate groove portion 122 is provided at a position overlapping the groove portion 112 of the base portion 110 in the direction parallel to the rotation shaft of the latch 100.

As illustrated in FIG. 3, the sub-base 130 is connected to the base portion 110 from the other side in the direction parallel to the rotation shaft of the latch 100 (front side in the depth direction of the page in FIG. 3). The sub-base 130 is made of metal. The sub-base 130 has a shape that covers the rotation shaft of the latch 100 and the rotation shaft of the lift lever 140. The rotation shaft of the latch 100 and the rotation shaft of the lift lever 140 are caulked and fixed to the sub-base 130. As a result, the sub-base 130 fixes the latch 100 and the lift lever 140 to the base portion 110.

In the present embodiment, the sub-base 130 has a pressing portion 132 that presses the blocking member 31 against the base portion 110 as illustrated in FIG. 3. The shape of the pressing portion 132 will be described later.

The actuator unit 20 is a unit including an electric mechanism 230 (see FIG. 1) that can be electrically switched between a lock state where the vehicle door is locked (vehicle door opening is prohibited) and an unlock state where the vehicle door is not locked (vehicle door opening is allowed) and is configured such that the latch unit 10 is connectable. As illustrated in FIG. 1, the actuator unit 20 has a switching mechanism 200, the electric mechanism 230, and a housing 240.

The housing 240 accommodates the switching mechanism 200 and the electric mechanism 230. The housing 240 is configured such that the base portion 110 is connectable. The housing 240 accommodates an open link, an open lever (an inside open lever and an outside open lever), and the like in addition to the switching mechanism 200 and the electric mechanism 230.

The switching mechanism 200 is a mechanism that switches between a lock state where the release of the engagement between the latch 100 and the striker during the door opening operation of the door operation handle provided on the vehicle door (vehicle door opening) is prohibited and an unlock state where the release of the engagement between the latch 100 and the striker during the door opening operation of the door operation handle is allowed. The switching mechanism 200 is accommodated in the housing 240. In the present embodiment, the switching mechanism 200 has an active lever 210 and a control lever 220.

The active lever 210 is held by the housing 240 so as to rotate around a support shaft provided in the housing 240 between an unlock position (position illustrated in FIG. 11) where the open link is positioned at a first position (position where the open link is capable of pushing up the lift lever 140) and a lock position (position indicated by a solid line in FIG. 12) where the open link is positioned at a second position (position where the open link is incapable of pushing up the lift lever 140). The switching mechanism 200 is in the unlock state when the active lever 210 is positioned at the unlock position and the switching mechanism 200 is in the lock state when the active lever 210 is positioned at the lock position. A moderation spring (not illustrated) that alternatively holds the active lever 210 at either the unlock position or the lock position is disposed in the housing 240.

The active lever 210 has a first lever 212 and a second lever 214 connected to the first lever 212. The first lever 212 is held by the housing 240 so as to rotate around the support shaft. The first lever 212 has a receiving portion 213 that receives an end portion of the control lever 220. The second lever 214 is held by the housing 240 so as to rotate around the support shaft in the direction opposite to the direction in which the first lever 212 rotates around the support shaft. The position of the second lever 214 is held by the moderation spring.

The control lever 220 is held by the housing 240 so as to rotate together with the active lever 210. The control lever 220 has a rotation center portion 222, an engagement end portion 224, a connecting portion 226, and a pressed portion 228.

The rotation center portion 222 is a part that is rotatably supported by a support shaft portion provided in the housing 240. The engagement end portion 224 is a part that engages with the receiving portion 213. The connecting portion 226 is a part that connects the rotation center portion 222 and the engagement end portion 224. The engagement end portion 224 rotates the first lever 212 by the control lever 220 rotating around the rotation center portion 222. In this manner, the active lever 210 rotates between the unlock position and the lock position.

The pressed portion 228 is connected to the connecting portion 226. The pressed portion 228 has a shape that projects toward the opening **112*h* from the part of the connecting portion 226 that faces the opening 112*h* in the insertion direction of the operation tool K. The pressed portion 228 has a shape extending in the orthogonal direction (vertical direction in FIG. 2). The upper end portion of the pressed portion 228 is positioned above the upper end portion of the opening 112*h* and the lower end portion of the pressed portion 228 is positioned below the lower end portion of the opening 112*h***.

The electric mechanism 230 is a mechanism that is capable of electrically switching the switching mechanism 200 between the lock state and the unlock state. The electric mechanism 230 is accommodated in the housing 240. The electric mechanism 230 switches the switching mechanism 200 to the lock state when the electric mechanism 230 receives a lock signal for locking the switching mechanism 200 from a remote controller (such as a key) when the switching mechanism 200 is in the unlock state. The electric mechanism 230 switches the switching mechanism 200 to the unlock state when the electric mechanism 230 receives an unlock signal for unlocking the switching mechanism 200 from the remote controller when the switching mechanism 200 is in the lock state.

In the present embodiment, the electric mechanism 230 has a motor (not illustrated) driven by receiving the lock signal or the unlock signal, a worm (not illustrated) connected to the drive shaft of the motor, and a worm wheel (not illustrated) meshing with the worm. The worm wheel is rotatably held by the housing 240 in a state where the worm wheel is engaged with the active lever 210 and the worm wheel switches the active lever 210 between the lock position and the unlock position by rotating relative to the housing 240.

Figure 5:
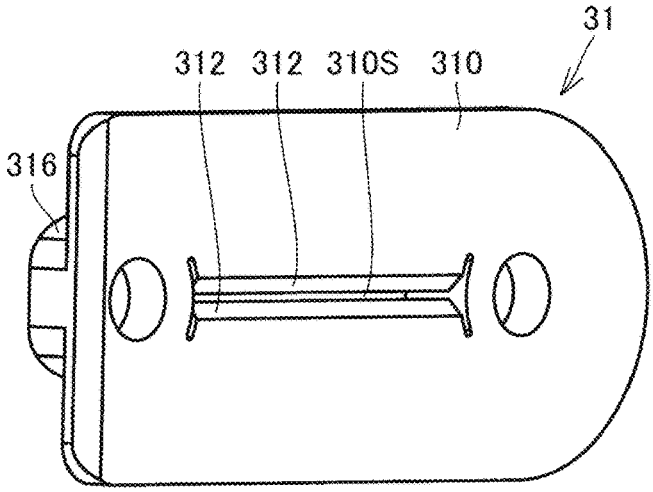
FIG. 5 is a perspective view of the blocking member.
Figure 6:
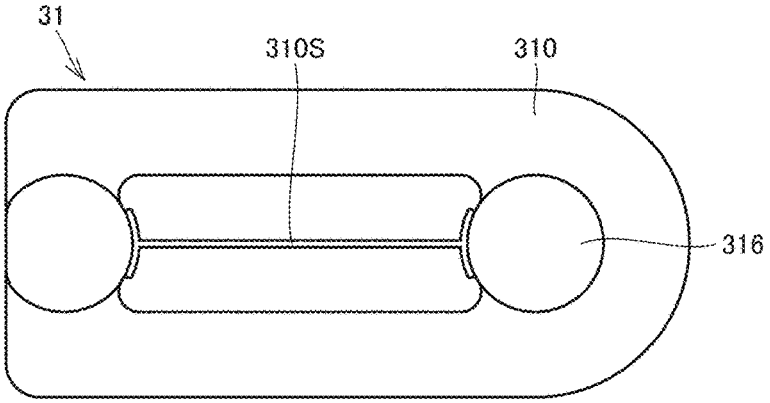
FIG. 6 is a rear view of the blocking member.
Figure 7:
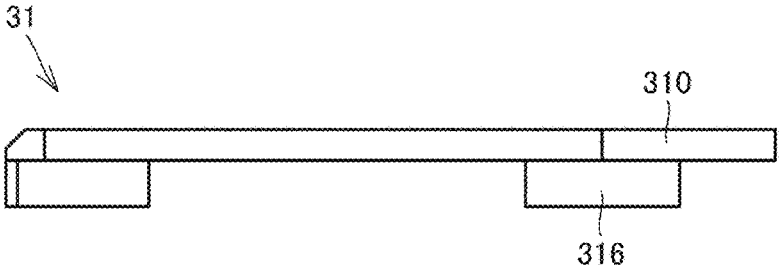
FIG. 7 is a bottom view of the blocking member.
Figure 8:
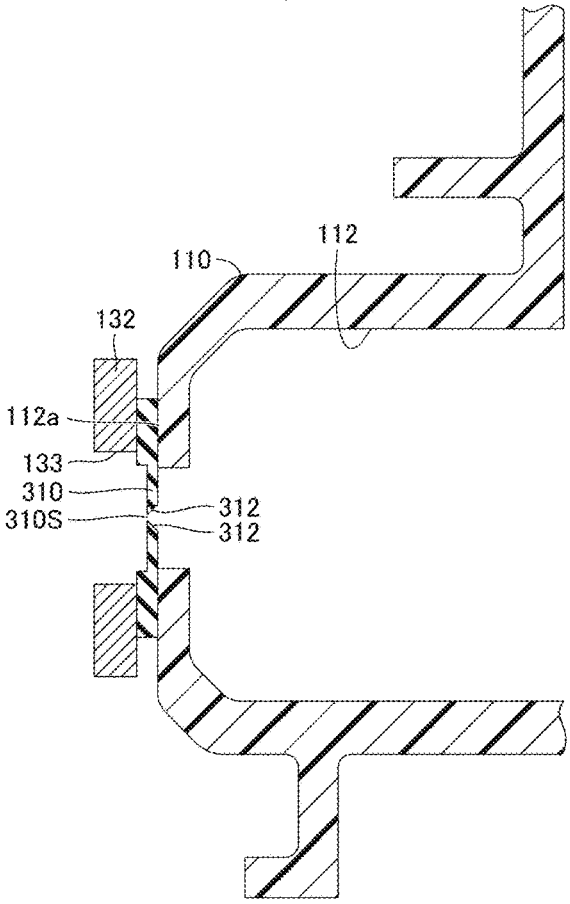
FIG. 8 is a cross-sectional view taken along line VIII-VIII illustrated in FIG. 3.

FIG. 5 is a perspective view of the blocking member. FIG. 6 is a rear view of the blocking member. FIG. 7 is a bottom view of the blocking member. FIG. 8 is a cross-sectional view taken along line VIII-VIII illustrated in FIG. 3.

The blocking member 31 is disposed inside the base portion 110 and the housing 240. The blocking member 31 has a shape that blocks the opening **112*h* of the base portion 110 and the blocking member 31 is connected to the back surface 112*a* of the groove portion 112. The opening 112*h* is provided at the part of the groove portion 112 that faces the pressed portion 228 of the switching mechanism 200. The blocking member 31 blocks the opening 112*h* when the operation tool K is not inserted through the opening 112*h***.

The blocking member 31 allows an insertion operation for inserting the operation tool K from the outside of the housing 240 into the housing 240 through the opening **112*h* and a switching operation for switching the switching mechanism 200 from the unlock state to the lock state by means of the operation tool K inserted in the housing 240 as a result of the insertion operation. In the present embodiment, the blocking member 31 has a blocking portion 310 and an engagement portion 316 as illustrated in FIGS. 5 to 7. The blocking member 31** is made of rubber.

The blocking portion 310 has a shape that blocks the opening 112*h*. The blocking portion 310 is formed in a flat plate shape. As illustrated in FIGS. 8 and 9, the blocking portion 310 is in surface contact with the back surface 112*a* of the groove portion 112. A slit 310S that allows the operation tool K to be inserted is formed in the blocking portion 310. The slit 310S has a shape extending along the latch engagement direction. As illustrated in FIGS. 2 and 8, the slit 310S is set very small with respect to the size of the opening 112*h*, entering of rainwater, dust, or the like into the housing 240 through the slit 310S is suppressed, and thus the blocking portion 310 has the function of blocking the opening 112*h*.

As illustrated in FIGS. 5 and 8, the blocking portion 310 has a pair of guide surfaces 312 provided at positions sandwiching the slit 310S in the orthogonal direction. The pair of guide surfaces 312 are shaped so as to approach each other from the outside of the housing 240 toward the inside of the housing 240. Specifically, as illustrated in FIG. 8, the pair of guide surfaces 312 are formed in an inclined tapered shape so as to approach each other from the groove portion 112 toward the inside of the housing 240.

The engagement portion 316 is a part connected to the blocking portion 310 and engaging with the holding portion 114. As illustrated in FIGS. 5, 6, 7, and 9, the engagement portion 316 has a recessed portion having a shape capable of receiving the holding portion 114. A recessed portion may constitute the holding portion 114 with the engagement portion 316 constituted by a protrusion portion that can be engaged with the recessed portion.

The pressing portion 132 will be described here. The pressing portion 132 presses the outer edge portion of the blocking portion 310 (part around the slit 310S and the engagement portion 316) against the back surface 112*a* of the groove portion 112. In other words, the outer edge portion of the blocking portion 310 is pinched between the pressing portion 132 and the back surface 112*a* of the groove portion 112. The engagement portion 316 and the slit 310S of the blocking member 31 are exposed from an edge portion 133 inside the pressing portion 132. The pressing portion 132 is formed integrally with the part of the sub-base 130 that covers the rotation shaft of the latch 100 and the rotation shaft of the lift lever 140.

Figure 10:
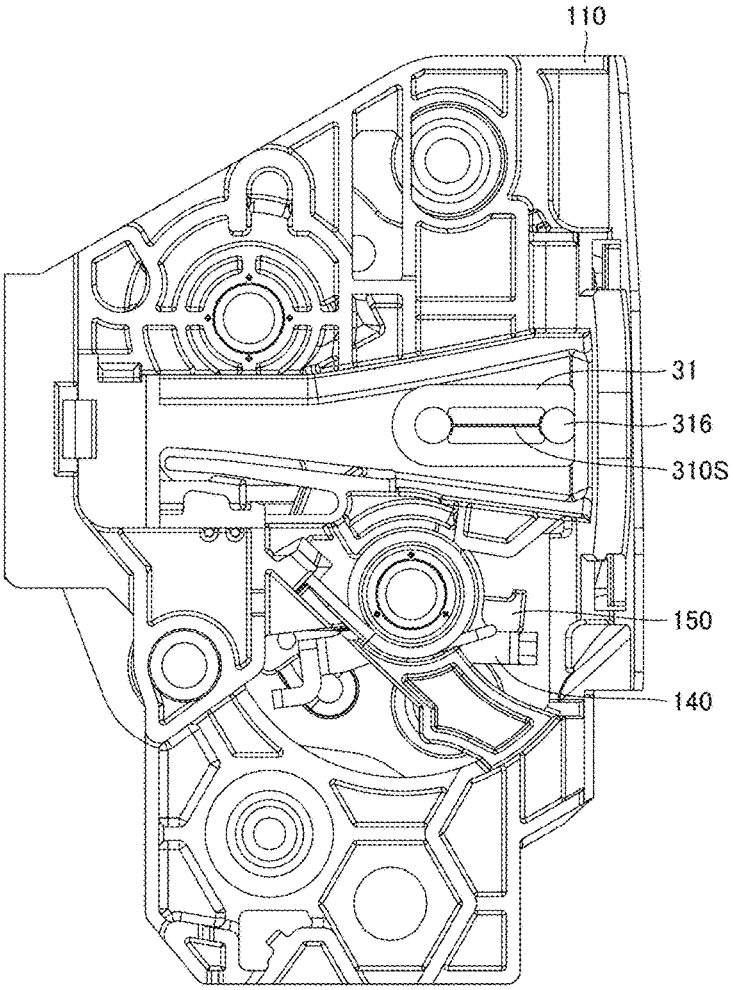
FIG. 10 is a rear view illustrating a state after blocking member assembly to the base portion.

Next, a method for assembling the blocking member 31 to the latch unit 10 will be described with reference to FIGS. 4, 10, and 3. FIG. 10 is a rear view illustrating a state after the assembly of blocking member to the base portion.

First, the engagement portion 316 is engaged with the holding portion 114 of the base portion 110 illustrated in FIG. 4. As a result, the blocking member 31 is positioned with respect to the base portion 110. The state after this engagement is illustrated in FIG. 10.

Subsequently, the sub-base 130 is assembled to the base portion 110. Specifically, the rotation shaft of the latch 100 and the rotation shaft of the lift lever 140 are caulked and fixed to the sub-base 130. As a result, the latch 100 and the lift lever 140 are fixed to the sub-base 130 and the pressing portion 132 presses the outer edge portion of the blocking member 31 against the back surface 112*a* of the groove portion 112. Accordingly, detachment of the blocking member 31 from the base portion 110 is suppressed.

The vehicular door lock device 1 is configured by the latch unit 10 to which the blocking member 31 is assembled as described above being assembled to the housing 240 of the actuator unit 20.

Figure 11:
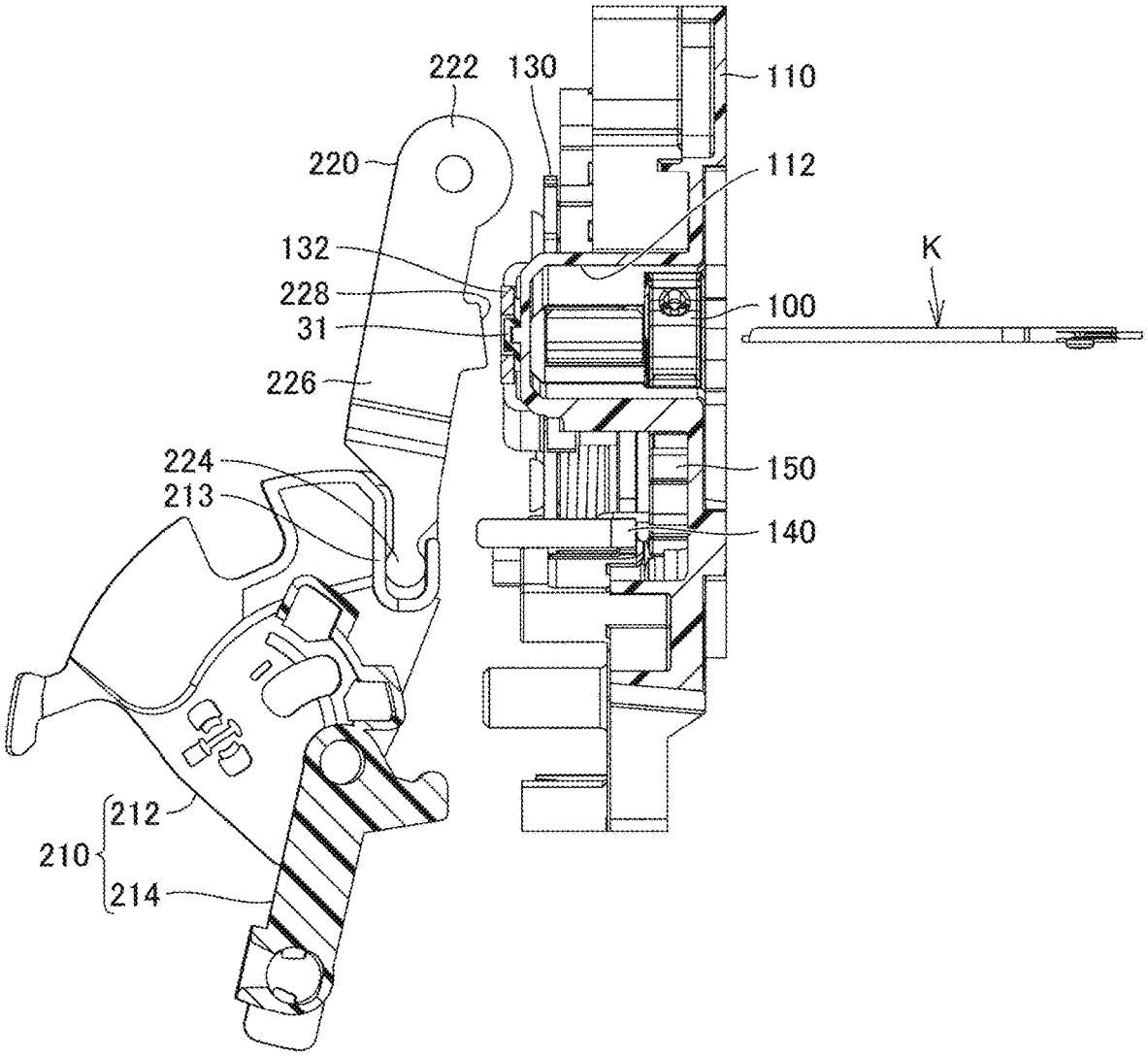
FIG. 11, which is a cross-sectional view taken along line XI-XI illustrated in FIG. 2, illustrates a switching mechanism that is in an unlock state and an operation tool that is yet to be inserted.
Figure 12:
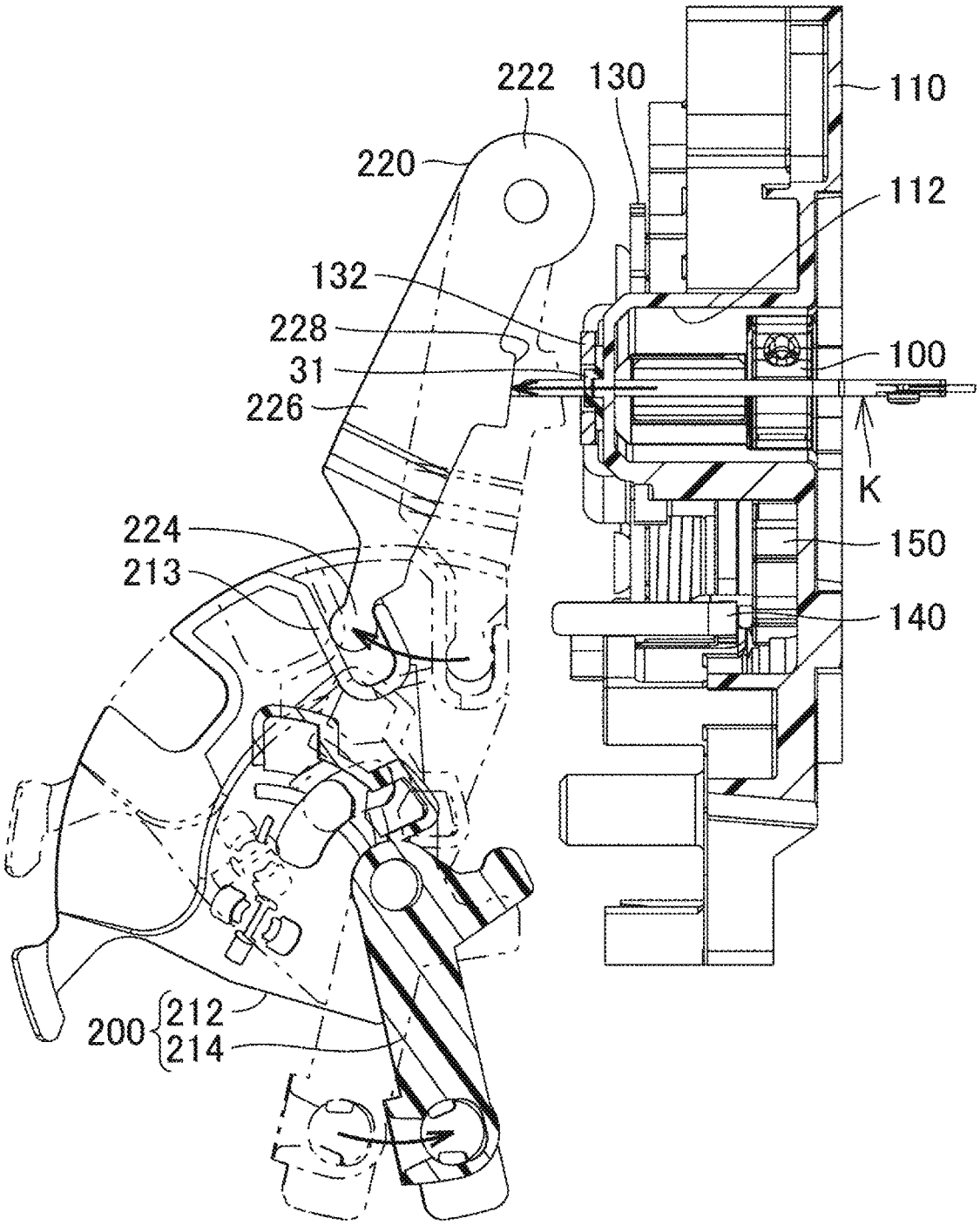
FIG. 12 is a cross-sectional view illustrating a state where the switching mechanism is switched from the unlock state to a lock state by the operation tool.

Next, how to switch the switching mechanism 200 to the lock state in the event of a vehicular electrical system fault (such as a flat battery) will be described with reference to FIGS. 11 and 12. FIG. 11, which is a cross-sectional view taken along line XI-XI illustrated in FIG. 2, illustrates the switching mechanism that is in the unlock state and the operation tool that is yet to be inserted. FIG. 12 is a cross-sectional view illustrating a state where the switching mechanism is switched from the unlock state to the lock state by the operation tool.

In a case where the electrical system fault has occurred with the switching mechanism 200 in the unlock state (state illustrated in FIG. 11), the vehicle door is opened by the door opening operation of the door operation handle and the groove portion 112 of the vehicular door lock device 1 is exposed to the outside first.

Next, the operation tool K is inserted into the housing 240 through the opening 112*h* formed in the groove portion 112 and the slit 310S of the blocking member 31 (the insertion operation is performed) and the pressed portion 228 is pressed against the biasing force of the moderation spring by means of the operation tool K (the switching operation is performed). Then, the engagement end portion 224 presses the receiving portion 213 by the control lever 220 rotating around the rotation center portion 222 as illustrated in FIG. 12, and thus the active lever 210 is switched from the unlock position to the lock position. As a result, the switching mechanism 200 is unlocked.

Subsequently, the opening 112*h* is blocked by the blocking portion 310 of the blocking member 31 when the operation tool K is pulled out from the opening 112*h*. Accordingly, entering of dust or the like into the housing 240 is suppressed.

As described above, the vehicular door lock device 1 of the present embodiment is provided with the blocking member 31, the blocking member 31 allows the insertion operation for inserting the operation tool K from the outside of the housing 240 into the housing 240 through the opening 112*h* and the switching operation for switching the switching mechanism 200 from the unlock state to the lock state by means of the inserted operation tool K, and the blocking member 31 blocks the opening 112*h* when the operation tool K is not inserted through the opening 112*h*. Accordingly, the switching mechanism 200 can be switched to the lock state through the opening 112*h* by means of the operation tool K in the case of a fault of the electrical system that operates the electric mechanism 230 (in the case of a flat battery or the like), the blocking member 31 blocks the opening 112*h* by the operation tool K being pulled out from the opening 112*h* after the switching of the switching mechanism 200 to the lock state, and thus entering of rainwater, dust, or the like into the housing 240 is suppressed.

Since the blocking portion 310 has the pair of guide surfaces 312, the tip end of the operation tool K is guided toward the slit 310S by the pair of guide surfaces 312 when the operation tool K is inserted. Accordingly, the insertion of the operation tool K into the opening 112*h* is facilitated.

The assembly of the blocking member 31 to the base portion 110 is facilitated since the base portion 110 has the holding portion 114.

The sub-base 130 that fixes the latch 100 to the base portion 110 has the pressing portion 132, and thus structural simplification is achieved as compared with a case where a dedicated member for pressing the blocking member 31 against the base portion 110 is provided.

The dimension W of the opening 112*h* in the latch engagement direction is larger than the dimension H of the opening 112*h* in the orthogonal direction. Accordingly, in a case where a key for locking and unlocking the vehicle door by being inserted into the key cylinder provided on the vehicle door is used as the operation tool K, the handle part of the key can also be inserted into the groove portion 112 by the key being inserted into the housing 240 through the opening 112*h* in a posture in which the width direction of the key is parallel to the longitudinal direction of the opening 112*h*. As a result, an operation stroke for switching the switching mechanism 200 is ensured.

Second Embodiment

Figure 13:
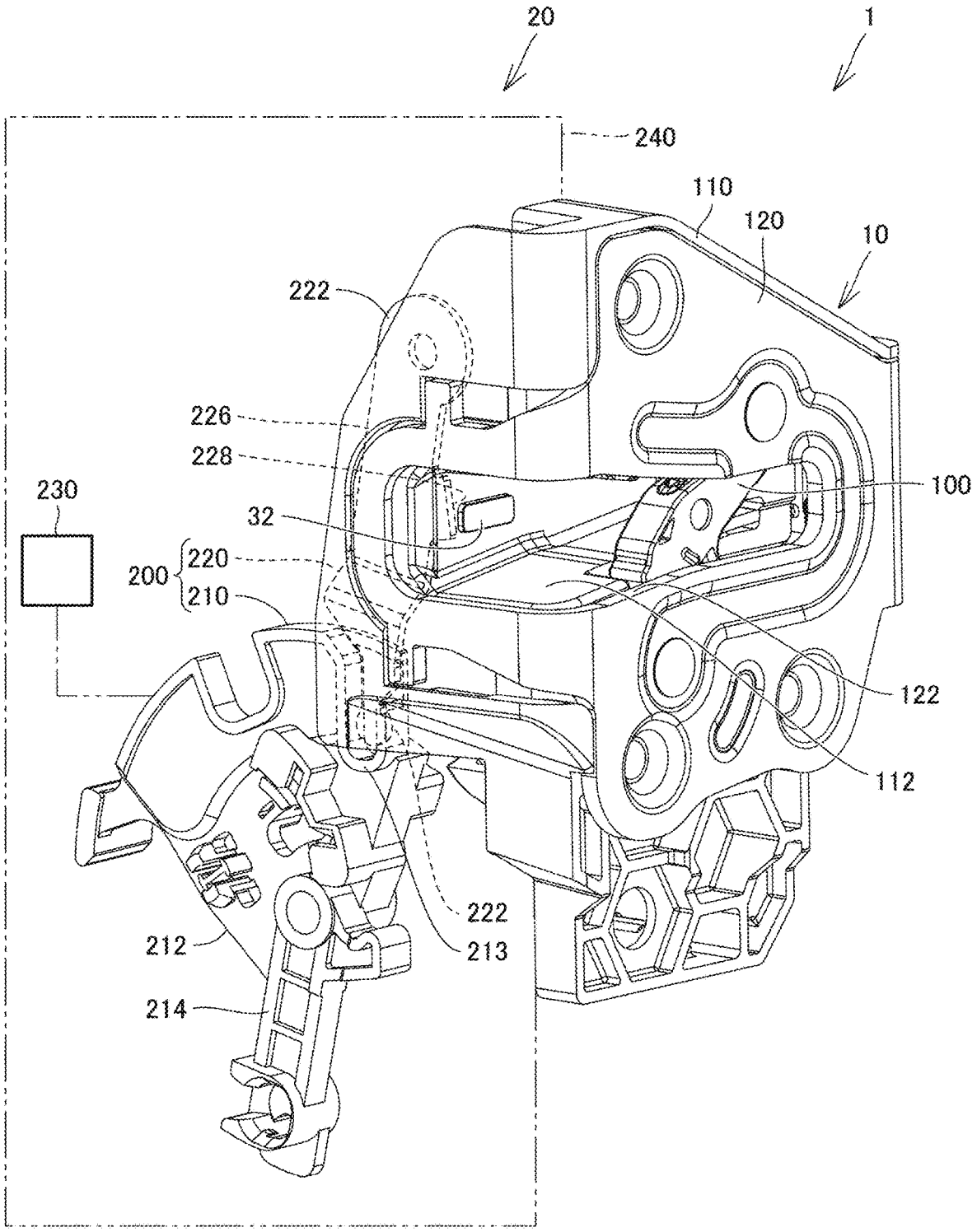
FIG. 13 is a perspective view of the vehicular door lock device according to a second embodiment disclosed here.
Figure 14:
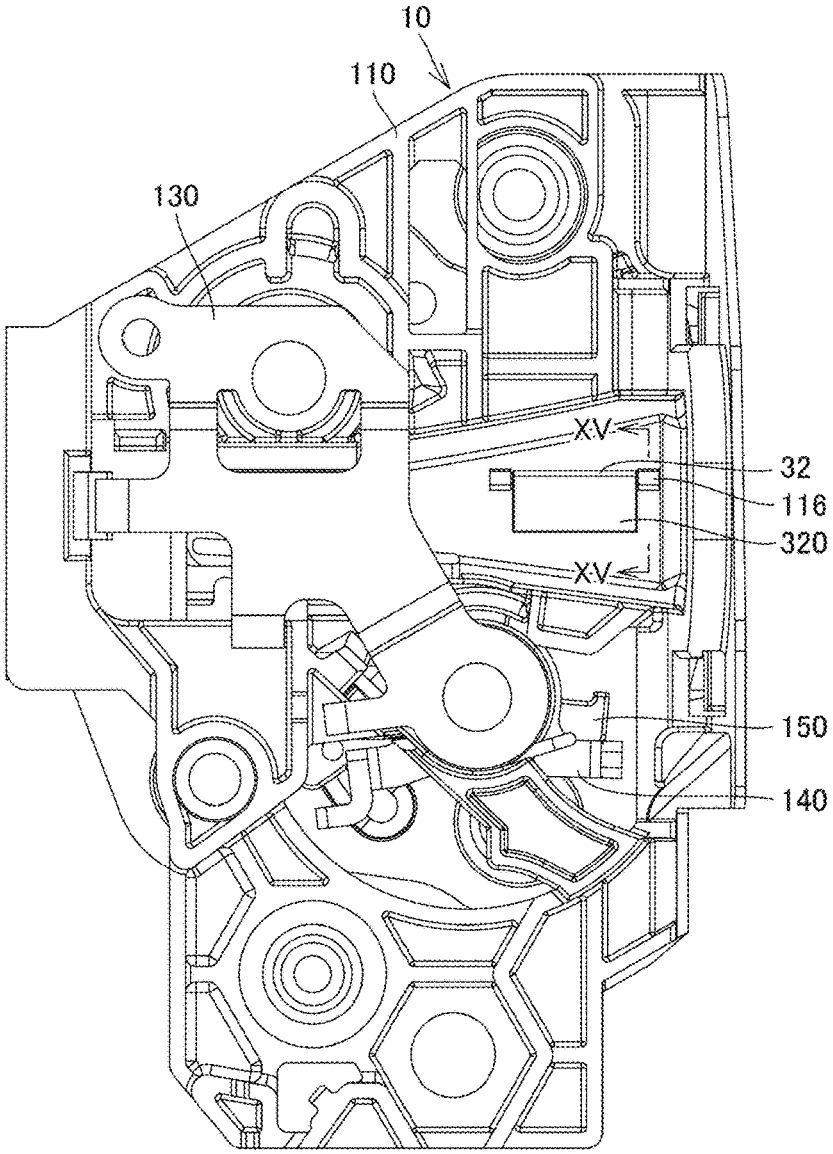
FIG. 14 is a rear view of the latch unit and a blocking member of the vehicular door lock device illustrated in FIG. 13.
Figure 15:
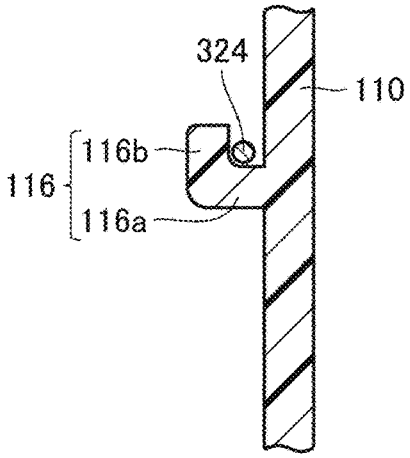
FIG. 15 is a cross-sectional view taken along line XV-XV illustrated in FIG. 14.
Figure 16:
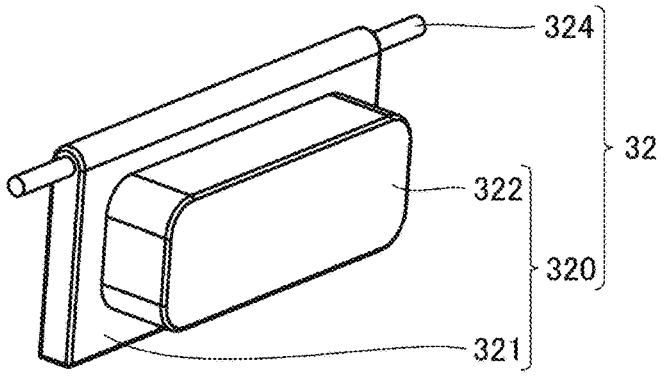
FIG. 16 is a perspective view of the blocking member.
Figure 17:
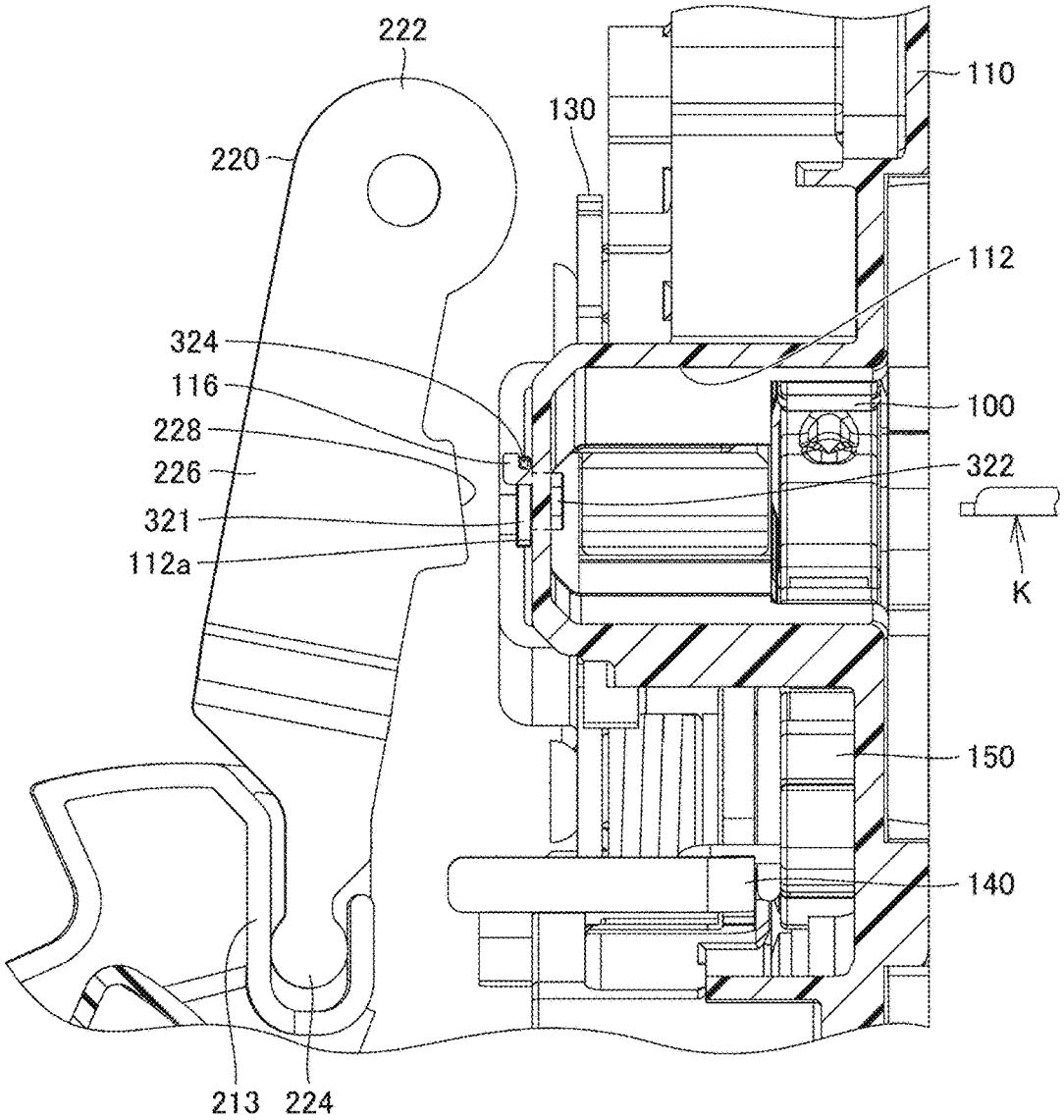
FIG. 17 is a cross-sectional view illustrating a state where the switching mechanism is unlocked and the operation tool is yet to be inserted.
Figure 18:
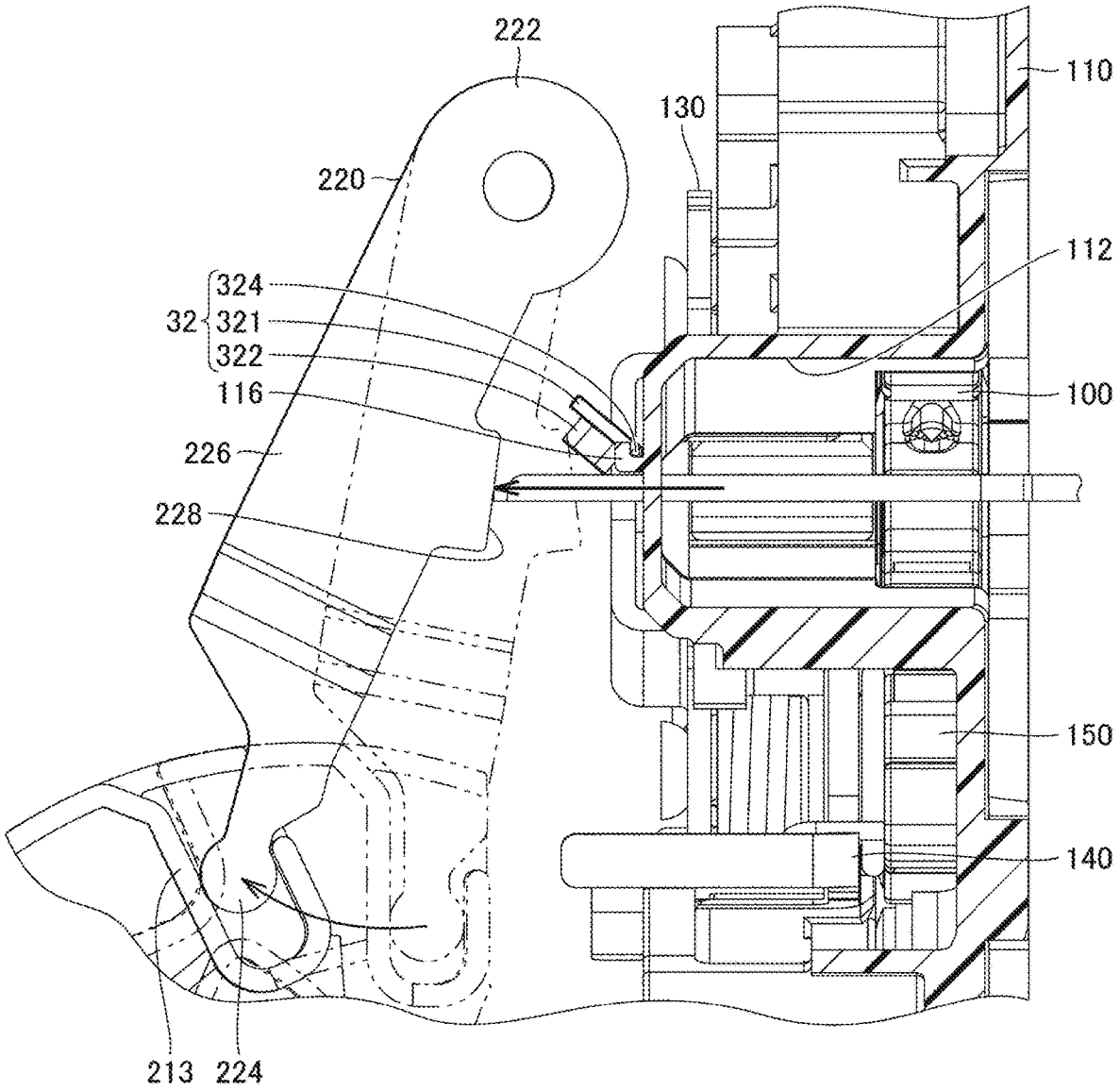
FIG. 18 is a cross-sectional view illustrating a state where the switching mechanism is switched from the unlock state to the lock state by the operation tool.

Next, the vehicular door lock device 1 according to a second embodiment disclosed here will be described with reference to FIGS. 13 to 18. FIG. 13 is a perspective view of the vehicular door lock device according to the second embodiment disclosed here. FIG. 14 is a rear view of the latch unit and a blocking member of the vehicular door lock device illustrated in FIG. 13. FIG. 15 is a cross-sectional view taken along line XV-XV illustrated in FIG. 14. FIG. 16 is a perspective view of the blocking member. FIG. 17 is a cross-sectional view illustrating a state where the switching mechanism is unlocked and the operation tool is yet to be inserted. FIG. 18 is a cross-sectional view illustrating a state where the switching mechanism is switched from the unlock state to the lock state by the operation tool. In the second embodiment, only the parts that are different from the first embodiment will be described and the same structure, action, and effect as in the first embodiment will not be described.

In the present embodiment, a blocking member 32 has a blocking portion 320 and a rotary shaft portion 324 as illustrated in FIG. 16 and the base portion 110 has a shaft holding portion 116 as illustrated in FIGS. 14 and 15. The base portion 110 does not have the holding portion 114 and the sub-base 130 does not have the pressing portion 132.

The blocking portion 320 has a shape that blocks the opening 112*h*. The blocking portion 320 has a lid portion 321 and a protrusion portion 322.

The lid portion 321 is formed in a flat plate shape larger than the opening 112*h*. The part of the front surface of the lid portion 321 that is around the opening 112*h* is in contact with the back surface 112*a* of the groove portion 112.

The protrusion portion 322 has a shape projecting from the front surface of the lid portion 321 toward the inside of the groove portion 112. As illustrated in FIG. 17, the dimension of projection of the protrusion portion 322 from the front surface of the lid portion 321 is larger than the thickness of the part of the base portion 110 that constitutes the groove portion 112.

The rotary shaft portion 324 is connected to the lid portion 321. The rotary shaft portion 324 has a shape extending along the direction parallel to the latch engagement direction.

The shaft holding portion 116 holds the rotary shaft portion 324. The shaft holding portion 116 holds the rotary shaft portion 324 so as to allow the blocking portion 320 to rotate around the rotary shaft portion 324 between a posture in which the blocking portion 320 blocks the opening 112*h* with its own weight when the operation tool K is not inserted through the opening 112*h* (posture illustrated in FIG. 17) and a posture in which the blocking portion 320 opens the opening 112*h* when the protrusion portion 322 of the blocking portion 320 is pressed by the operation tool K from the outside of the housing 240 into the housing 240 through the opening 112*h* (posture illustrated in FIG. 18). As illustrated in FIG. 15, the shaft holding portion 116 has a bottom wall 116*a* that receives the rotary shaft portion 324 from below and a side wall 116*b* that stands up from the bottom wall 116*a* and receives the rotary shaft portion 324 from the side.

Next, how to switch the switching mechanism 200 to the lock state in the event of a vehicular electrical system fault (such as a flat battery) will be described with reference to FIGS. 17 and 18.

First, the vehicle door is opened and the groove portion 112 of the vehicular door lock device 1 is exposed to the outside as in the first embodiment. Next, the operation tool K is inserted into the housing 240 through the opening 112*h* formed in the groove portion 112 (the insertion operation is performed). Then, the protrusion portion 322 of the blocking portion 320 is pressed against the operation tool K, and thus the blocking portion 320 rotates around the rotary shaft portion 324 so as to change from the posture in which the opening 112*h* is blocked to the posture in which the opening 112*h* is opened.

Subsequently, the operation tool K is inserted as it is and the pressed portion 228 is pressed against the biasing force of the moderation spring by means of the operation tool K (the switching operation is performed). Then, the engagement end portion 224 presses the receiving portion 213 by the control lever 220 rotating around the rotation center portion 222 as illustrated in FIG. 18, and thus the active lever 210 is switched from the unlock position to the lock position. As a result, the switching mechanism 200 is unlocked.

The operation tool K is subsequently pulled out from the opening 112*h*, and then the blocking member 31 returns to the posture in which the opening 112*h* is blocked by its own weight (posture in which the front surface of the lid portion 321 comes into contact with the back surface 112*a* of the groove portion 112). Accordingly, entering of dust or the like into the housing 240 is suppressed.

Third Embodiment

Figure 19:
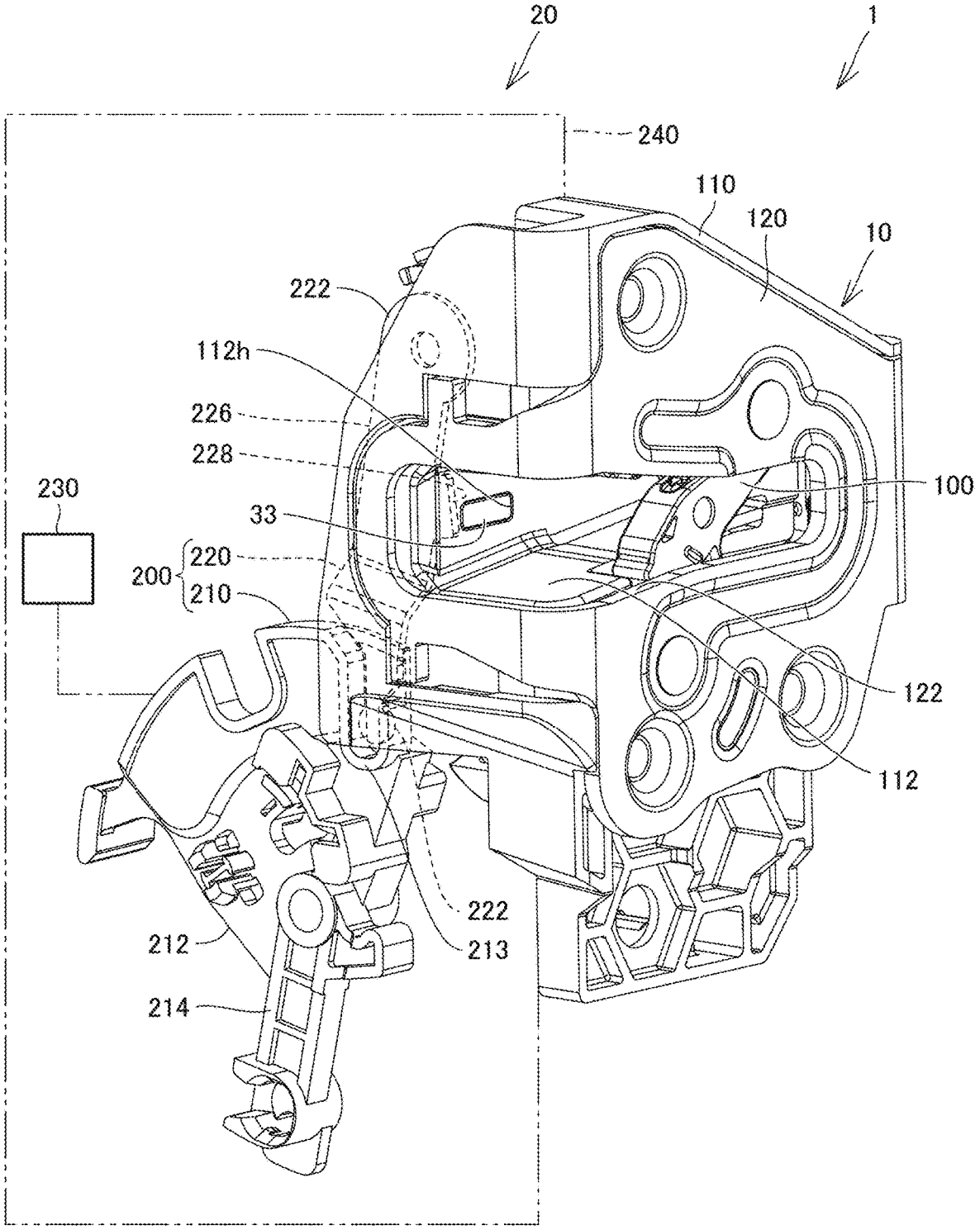
FIG. 19 is a perspective view of the vehicular door lock device according to a third embodiment disclosed here.
Figure 20:
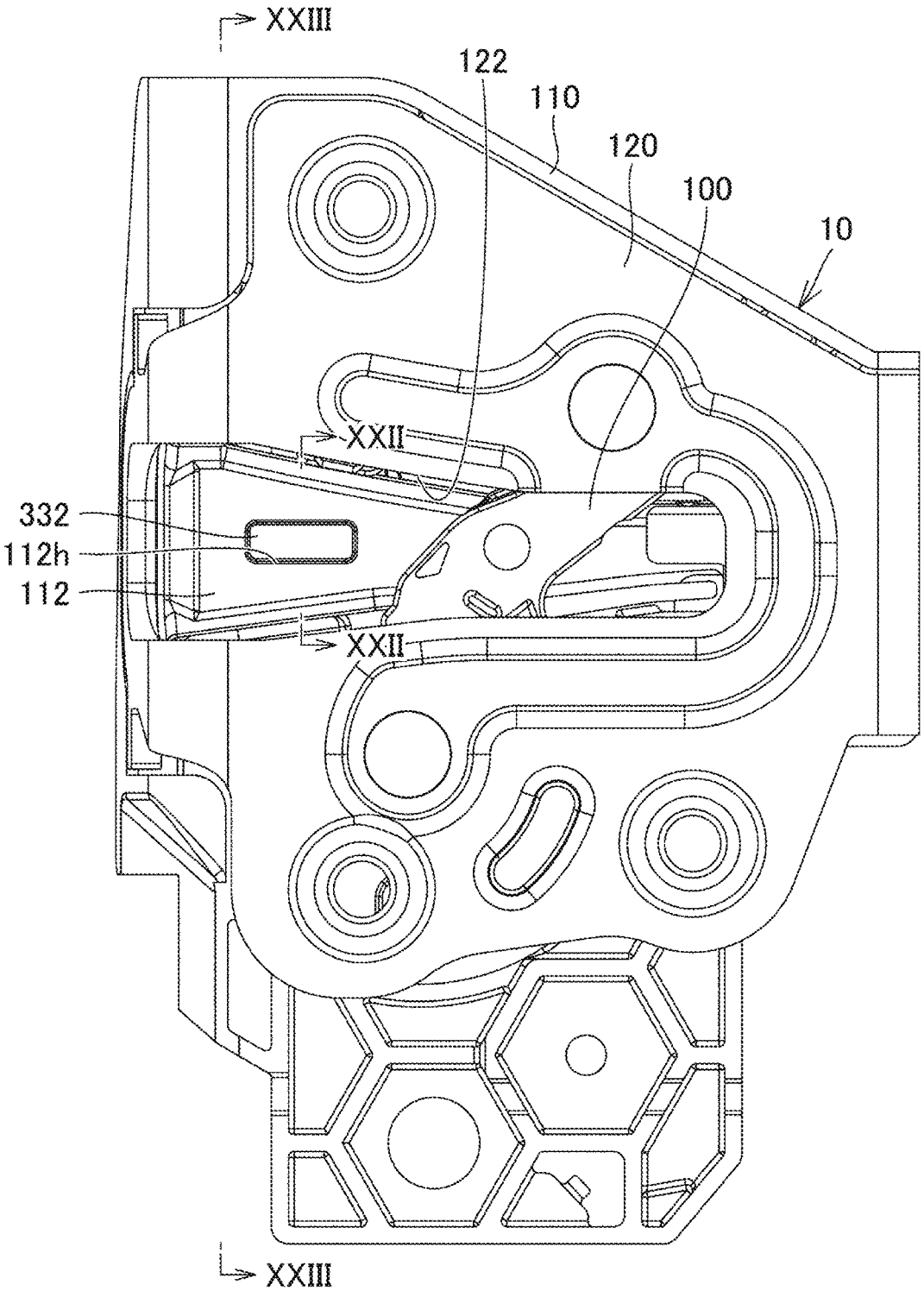
FIG. 20 is a plan view of the latch unit and a blocking member of the vehicular door lock device illustrated in FIG. 19.
Figure 21:
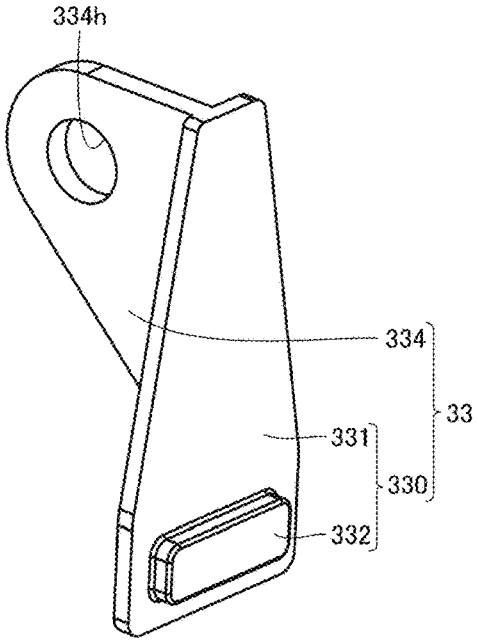
FIG. 21 is a perspective view of the blocking member.
Figure 22:
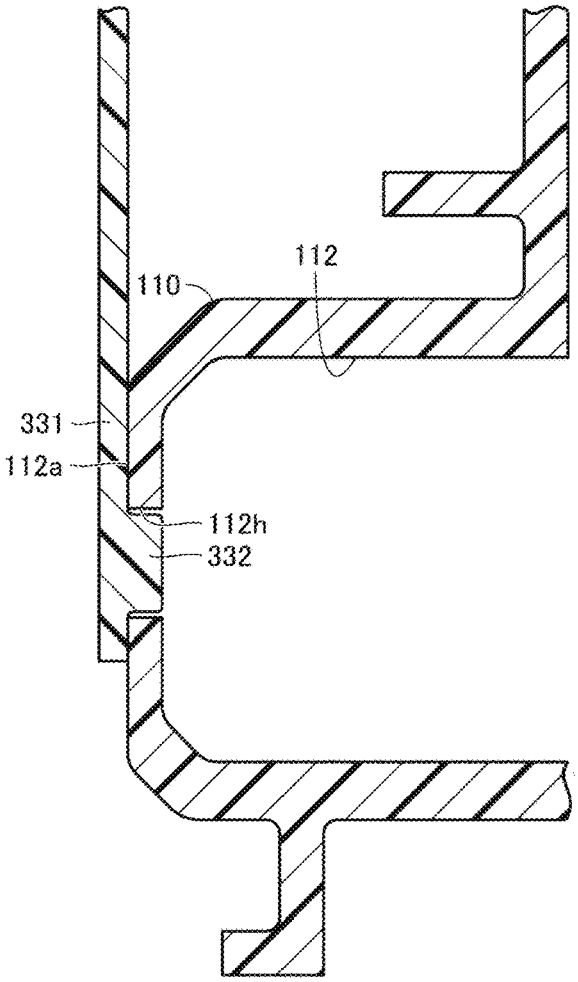
FIG. 22 is a cross-sectional view taken along line XXII-XXII illustrated in FIG. 20.
Figure 23:
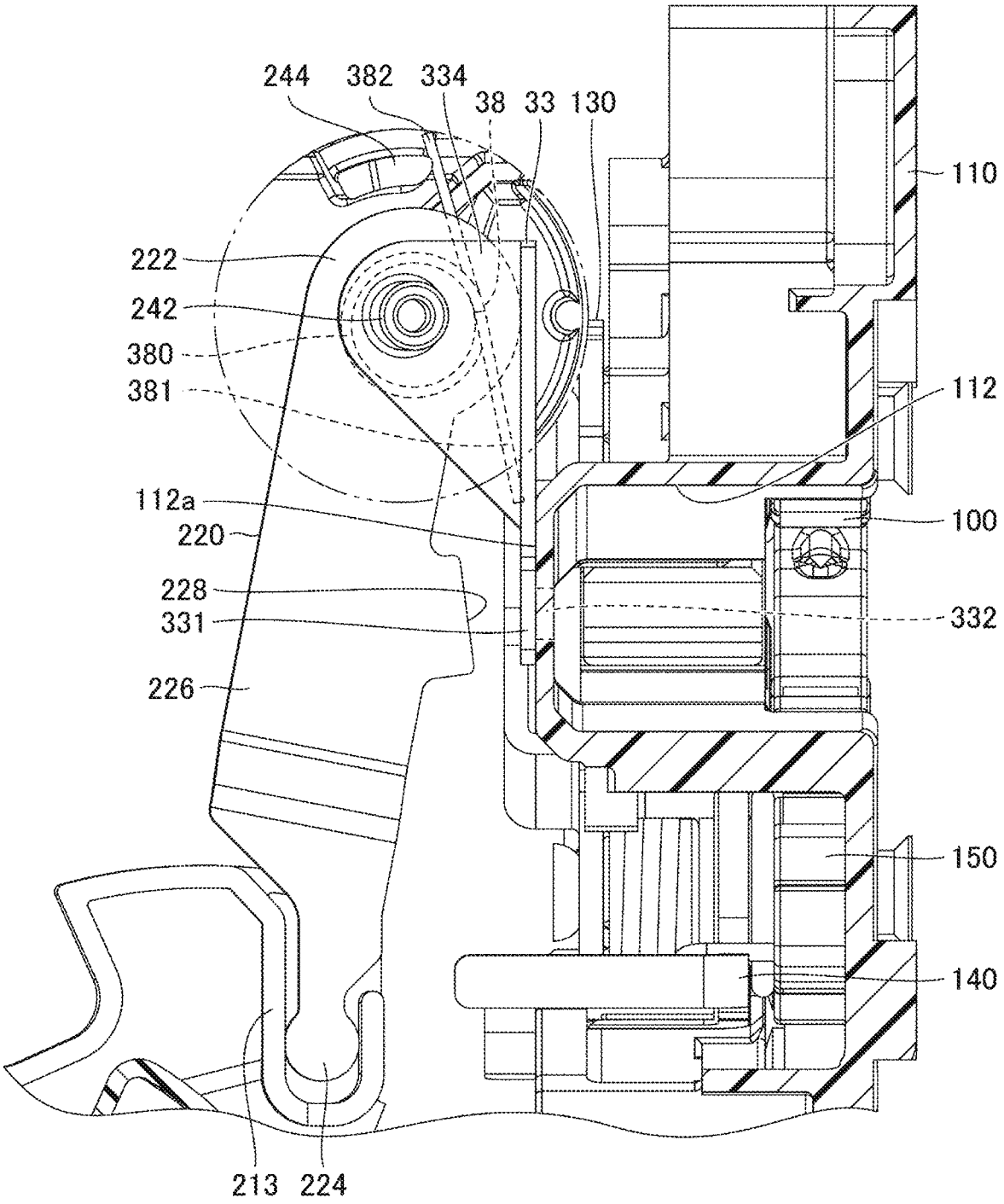
FIG. 23 is a cross-sectional view taken along line XXIII-XXIII illustrated in FIG. 20.
Figure 24:
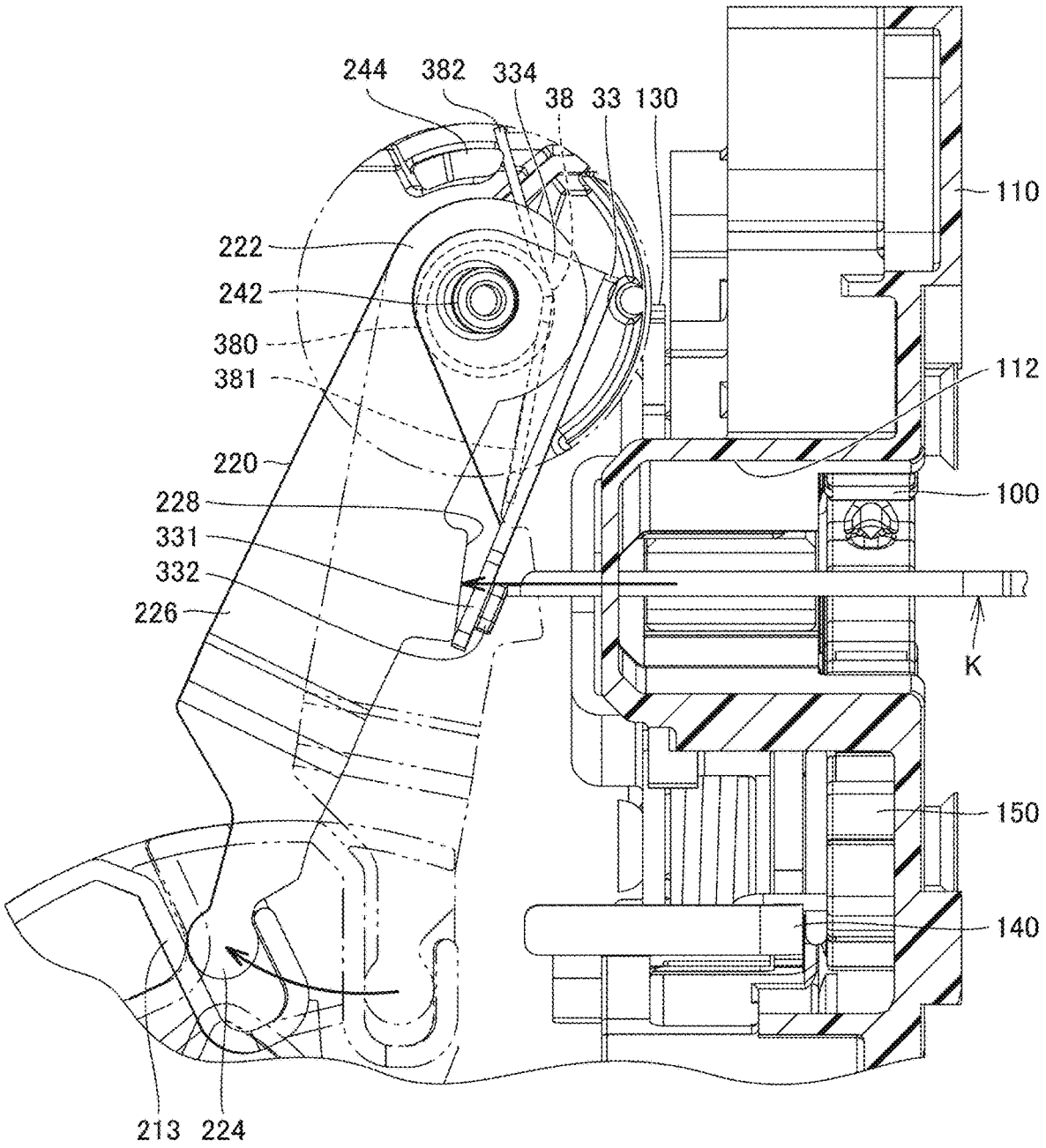
FIG. 24 is a cross-sectional view illustrating a state where the switching mechanism is switched from the unlock state to the lock state by the operation tool.
Figure 25:
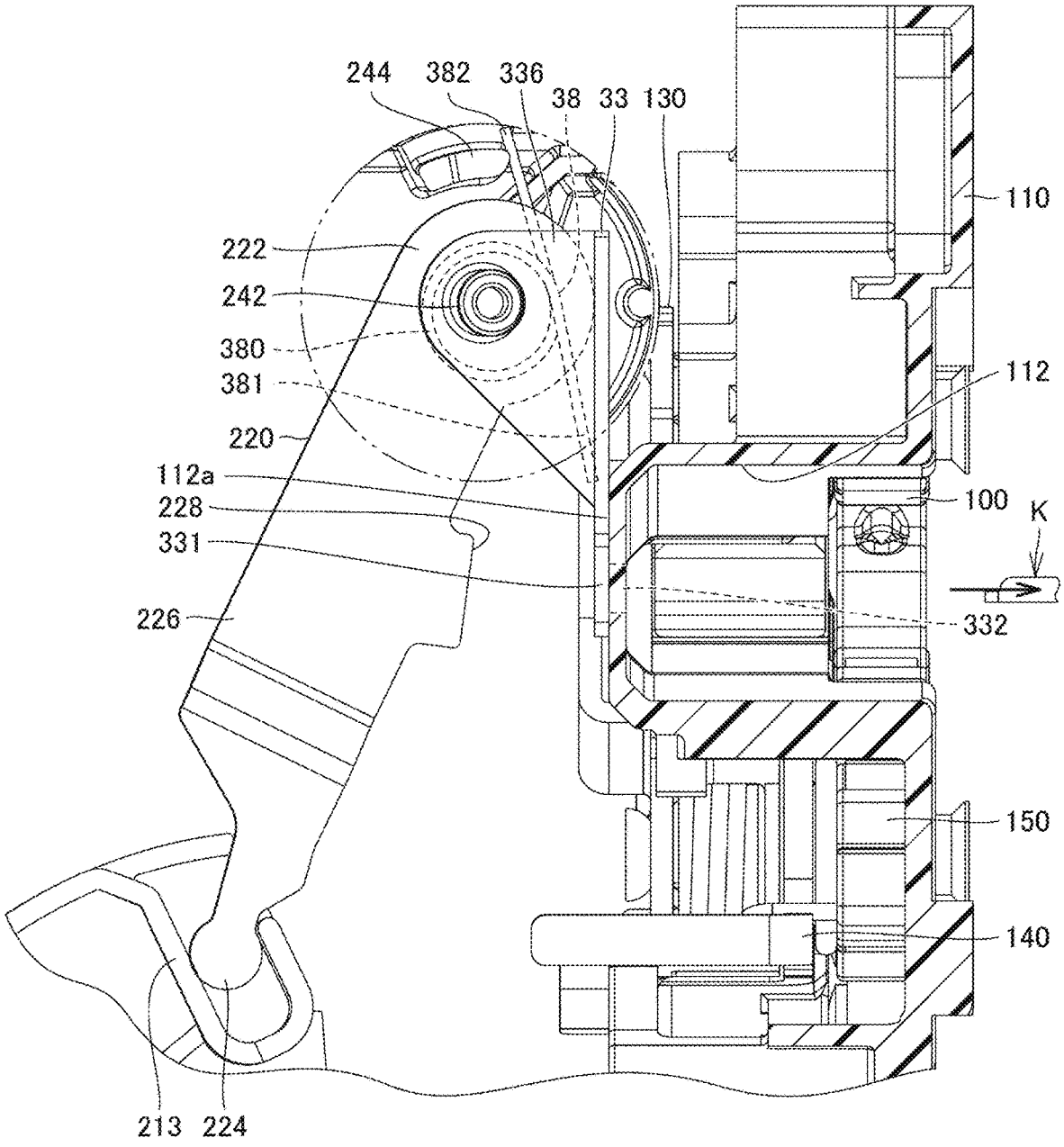
FIG. 25 is a cross-sectional view illustrating a state where the operation tool is pulled out from the state that is illustrated in FIG. 24.

Next, the vehicular door lock device 1 according to a third embodiment disclosed here will be described with reference to FIGS. 19 to 25. FIG. 19 is a perspective view of the vehicular door lock device according to the third embodiment disclosed here. FIG. 20 is a plan view of the latch unit and a blocking member of the vehicular door lock device illustrated in FIG. 19. FIG. 21 is a perspective view of the blocking member. FIG. 22 is a cross-sectional view taken along line XXII-XXII illustrated in FIG. 20. FIG. 23 is a cross-sectional view taken along line XXIII-XXIII illustrated in FIG. 20. FIG. 24 is a cross-sectional view illustrating a state where the switching mechanism is switched from the unlock state to the lock state by the operation tool. FIG. 25 is a cross-sectional view illustrating a state where the operation tool is pulled out from the state that is illustrated in FIG. 24. In the third embodiment, only the parts that are different from the first embodiment will be described and the same structure, action, and effect as in the first embodiment will not be described.

The vehicular door lock device 1 according to the present embodiment further includes a biasing member 38 that biases a blocking member 33 as illustrated in FIGS. 23 to 25. The blocking member 33 has a blocking portion 330 and a supported portion 334 as illustrated in FIG. 21 and the housing 240 has a support shaft portion 242 and a biasing member engagement portion 244 as illustrated in FIGS. 23 to 25. In FIGS. 23 to 25, the housing 240 is illustrated only in a circular region indicated by a two-dot chain line. The base portion 110 does not have the holding portion 114 and the sub-base 130 does not have the pressing portion 132.

The blocking portion 330 has a shape that blocks the opening 112*h*. The blocking portion 330 has a lid portion 331 and a protrusion portion 332.

The lid portion 331 is formed in a flat plate shape larger than the opening 112*h*. The part of the front surface of the lid portion 331 that is around the opening 112*h* is in contact with the back surface 112*a* of the groove portion 112.

The protrusion portion 332 has a shape projecting from the front surface of the lid portion 331 toward the inside of the groove portion 112. As illustrated in FIG. 22, the dimension of projection of the protrusion portion 332 from the front surface of the lid portion 331 is set equal to the thickness of the part of the base portion 110 that constitutes the groove portion 112.

The supported portion 334 is formed in a flat plate shape protruding from the back surface of the lid portion 331. The supported portion 334 is connected to the lid portion 331 in a posture intersecting with the lid portion 331. The supported portion 334 is provided with a circular insertion hole 334*h*.

The biasing member 38 biases the blocking portion 330 toward the base portion 110. A torsion spring constitutes the biasing member 38. The biasing member 38 has a coil portion 380, a first leg portion 381 extending from the coil portion 380, and a second leg portion 382 extending from the coil portion 380 in a direction different from the direction in which the first leg portion 381 extends from the coil portion 380.

The support shaft portion 242 supports the rotation center portion 222 of the control lever 220 so as to be rotatable. The support shaft portion 242 is inserted in the insertion hole 334*h* of the supported portion 334. In other words, the support shaft portion 242 supports the blocking member 33 such that the blocking portion 330 rotates around the supported portion 334. Specifically, the support shaft portion 242 supports the supported portion 334 so as to allow the blocking portion 330 to rotate around the support shaft portion 242 between a posture in which the blocking portion 330 blocks the opening 112*h* when the operation tool K is not inserted through the opening 112*h* (posture illustrated in FIGS. 23 and 25) and a posture in which the blocking portion 330 opens the opening 112*h* when the protrusion portion 332 of the blocking portion 330 is pressed by the operation tool K from the outside of the housing 240 into the housing 240 through the opening 112*h* (posture illustrated in FIG. 24).

In the present embodiment, the support shaft portion 242 supports the biasing member 38 in a state where the biasing member 38 biases the blocking portion 330 toward the back surface 112*a* of the groove portion 112. Specifically, the support shaft portion 242 supports the coil portion 380 such that the first leg portion 381 biases the back surface of the lid portion 331 to the back surface 112*a* of the groove portion 112.

The biasing member engagement portion 244 is provided at a position separated from the support shaft portion 242 and holds the second leg portion 382.

Next, how to switch the switching mechanism 200 to the lock state in the event of a vehicular electrical system fault (such as a flat battery) will be described with reference to FIGS. 23 to 25.

First, the vehicle door is opened and the groove portion 112 of the vehicular door lock device 1 is exposed to the outside as in the first embodiment. Subsequently, the operation tool K is inserted into the housing 240, with the biasing force of the biasing member 38 resisted, through the opening 112*h* formed in the groove portion 112 (the insertion operation is performed). Then, the protrusion portion 332 of the blocking portion 330 is pressed against the operation tool K, and thus the blocking portion 330 rotates around the support shaft portion 242 so as to change from the posture in which the opening 112*h* is blocked to the posture in which the opening 112*h* is opened.

Subsequently, the operation tool K is inserted with the biasing force of the biasing member 38 resisted as it is and the pressed portion 228 is pressed via the blocking portion 330 by the operation tool K with the biasing force of the moderation spring resisted (the switching operation is performed). Then, the engagement end portion 224 presses the receiving portion 213 by the control lever 220 rotating around the rotation center portion 222 as illustrated in FIG. 24, and thus the active lever 210 is switched from the unlock position to the lock position. As a result, the switching mechanism 200 is unlocked.

The operation tool K is subsequently pulled out from the opening 112*h*, and then the blocking member 31 returns to the posture in which the blocking member 31 blocks the opening 112*h* by being biased by the biasing member 38 (posture in which the front surface of the lid portion 331 comes into contact with the back surface 112*a* of the groove portion 112) as illustrated in FIG. 25. Accordingly, entering of dust or the like into the housing 240 is suppressed.

The support shaft portion 242 supports all of the control lever 220, the coil portion 380, and the supported portion 334, and thus structural simplification is achieved as compared with a case where a dedicated part for supporting each is provided.

A vehicular door lock device according to an aspect of this disclosure includes a base portion rotatably supporting a latch holding a vehicle door in a closed state by engaging with a striker, a switching mechanism switching between a lock state where releasing of the engagement between the latch and the striker during a door opening operation of a door operation handle provided on the vehicle door is prohibited and an unlock state where releasing of the engagement between the latch and the striker during the door opening operation of the door operation handle is allowed, an electric mechanism capable of electrically switching the switching mechanism between the lock state and the unlock state, a housing accommodating the switching mechanism and the electric mechanism and connected to the base portion, and a blocking member disposed in the housing. An opening through which an operation tool is insertable from an outside of the base portion into the housing is provided at a part of the base portion facing the switching mechanism. The blocking member allows an operation for inserting the operation tool from an outside of the housing into the housing through the opening and an operation for switching the switching mechanism from the unlock state to the lock state by means of the operation tool inserted in the housing as a result of the operation, and blocks the opening when the operation tool is not inserted through the opening.

The vehicular door lock device is provided with the blocking member, the blocking member allows the insertion operation for inserting the operation tool (such as a key) from the outside of the housing into the housing through the opening and the switching operation for switching the switching mechanism from the unlock state to the lock state by means of the inserted operation tool, and the blocking member blocks the opening when the operation tool is not inserted through the opening. Accordingly, the switching mechanism can be switched to the lock state through the opening by means of the operation tool in the case of a fault of the electrical system that operates the electric mechanism (in the case of a flat battery or the like), the blocking member blocks the opening by the operation tool being pulled out from the opening after the switching of the switching mechanism to the lock state, and thus entering of rainwater, dust, or the like into the housing is suppressed.

In the aspect of this disclosure, the blocking member may be made of rubber and have a blocking portion for blocking the opening and a slit allowing the operation tool to be inserted therein may be formed in the blocking portion.

In this configuration, entering of rainwater, dust, or the like into the housing is effectively suppressed.

In the aspect of this disclosure, the blocking portion may have a pair of guide surfaces provided at positions sandwiching the slit. In this case, it is preferable that the pair of guide surfaces are shaped so as to approach each other from the outside of the housing toward an inside of the housing.

In this configuration, the tip end of the operation tool is guided toward the slit by the pair of guide surfaces when the operation tool is inserted, and thus operation tool insertion into the opening is facilitated.

In the aspect of this disclosure, the base portion may have a holding portion holding the blocking member at a position where the blocking portion blocks the opening.

In this configuration, assembly of the blocking member to the base portion is facilitated.

The vehicular door lock device according to the aspect of this disclosure may further include a sub-base connected to the base portion from an inner side of the housing and fixing the latch to the base portion. In this case, it is preferable that the sub-base has a pressing portion pressing the blocking member against the base portion.

In this manner, the sub-base that fixes the latch to the base portion also has the function of pressing the blocking member against the base portion, and thus structural simplification is achieved as compared with a case where a dedicated member for pressing the blocking member against the base portion is provided.

In the aspect of this disclosure, the blocking member may have a blocking portion having a shape blocking the opening and a rotary shaft portion connected to the blocking portion. In this case, it is preferable that the base portion has a shaft holding portion holding the rotary shaft portion and the shaft holding portion holds the rotary shaft portion so as to allow the blocking portion to rotate around the rotary shaft portion between a posture in which the blocking portion blocks the opening with a weight of the blocking portion when the operation tool is not inserted through the opening and a posture in which the blocking portion opens the opening when the blocking portion is pressed by the operation tool from the outside of the housing toward an inside of the housing through the opening.

Also in this configuration, entering of rainwater, dust, or the like into the housing is effectively suppressed.

Alternatively, the vehicular door lock device according to the aspect of this disclosure may further include a biasing member disposed in the housing and the blocking member may have a blocking portion having a shape blocking the opening and a supported portion connected to the blocking portion. In this case, it is preferable that the housing has a support shaft portion supporting the supported portion, the support shaft portion supports the supported portion so as to allow the blocking portion to rotate around the support shaft portion between a posture in which the blocking portion blocks the opening when the operation tool is not inserted through the opening and a posture in which the blocking portion opens the opening when the blocking portion is pressed by the operation tool from the outside of the housing toward an inside of the housing through the opening, and the biasing member biases the blocking portion toward the base portion.

In this configuration, the blocking portion is pressed against the base portion by the biasing member when the operation tool is not inserted through the opening, and thus entering of rainwater, dust, or the like into the housing is more reliably suppressed.

In the aspect of this disclosure, the support shaft portion may rotatably support the switching mechanism and support the biasing member in a state where the biasing member biases the blocking portion toward the base portion.

In this manner, the common support shaft portion supports all of the switching mechanism, the biasing member, and the blocking member, and thus structural simplification is achieved as compared with a case where a dedicated part for supporting each is provided.

In the aspect of this disclosure, the base portion may have a groove portion allowing the striker to enter therein and the opening may be formed in the groove portion. In this case, it is preferable that a dimension of the opening in a latch engagement direction parallel to a direction in which the latch engages with the striker is larger than a dimension of the opening in a direction orthogonal to both an insertion direction of the operation tool and the latch engagement direction.

In this manner, in a case where a key for locking and unlocking the vehicle door by being inserted into the key cylinder provided on the vehicle door is used as the operation tool, the handle part of the key can also be inserted into the groove portion by the key being inserted into the housing through the opening in a posture in which the width direction of the key is parallel to the longitudinal direction of the opening. As a result, an operation stroke for switching the switching mechanism is ensured.

As described above, according to this disclosure, it is possible to provide a vehicular door lock device that can be switched from an unlock state to a lock state by an operation tool and is capable of suppressing entering of rainwater, dust, or the like into a housing after the switching to the lock state.

It should be noted that the embodiments disclosed herein are illustrative in all respects and are not restrictive. The scope disclosed here is shown not by the above description of the embodiments but by the scope of claims and further includes every modification within the meaning and scope equivalent to the scope of claims.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A vehicular door lock device comprising:

a base portion rotatably supporting a latch holding a vehicle door in a closed state by engaging with a striker;

a switching mechanism switching between a lock state where releasing of the engagement between the latch and the striker during a door opening operation of a door operation handle provided on the vehicle door is prohibited and an unlock state where releasing of the engagement between the latch and the striker during the door opening operation of the door operation handle is allowed;

an electric mechanism capable of electrically switching the switching mechanism between the lock state and the unlock state;

a housing accommodating the switching mechanism and the electric mechanism and connected to the base portion; and a blocking member disposed in the housing, wherein an opening through which an operation tool is insertable from an outside of the base portion into the housing is provided at a part of the base portion facing the switching mechanism, the blocking member allows an operation for inserting the operation tool from an outside of the housing into the housing through the opening and an operation for switching the switching mechanism from the unlock state to the lock state by means of the operation tool inserted in the housing as a result of the operation, and blocks the opening when the operation tool is not inserted through the opening, the blocking member is made of rubber and has a blocking portion having a shape blocking the opening, and a slit allowing the operation tool to be inserted therein is formed in the blocking portion.

2. The vehicular door lock device according to claim 1, wherein the blocking portion has a pair of guide surfaces provided at positions sandwiching the slit, and the pair of guide surfaces are shaped so as to approach each other from the outside of the housing toward an inside of the housing.

3. The vehicular door lock device according to claim 1, wherein the base portion has a holding portion holding the blocking member at a position where the blocking portion blocks the opening.

4. The vehicular door lock device according to claim 1, further comprising a sub-base connected to the base portion from an inner side of the housing and fixing the latch to the base portion, wherein the sub-base has a pressing portion pressing the blocking member against the base portion.

5. The vehicular door lock device according to claim 1, wherein the base portion has a groove portion allowing the striker to enter therein, the opening is formed in the groove portion, and a dimension of the opening in a latch engagement direction parallel to a direction in which the latch engages with the striker is larger than a dimension of the opening in a direction orthogonal to both an insertion direction of the operation tool and the latch engagement direction.

6. The vehicular door lock device according to claim 1, further comprising a sub-base connected to the base portion from an inner side of the housing and fixing the latch to the base portion, wherein the blocking portion has a pair of guide surfaces provided at positions sandwiching the slit, and the sub-base has a pressing portion contacting a side of the blocking member opposite a side of the blocking member having the pair of guide surfaces to press the blocking member against the base portion.

* * * * *